US009978335B2

(12) United States Patent
Koh et al.

(10) Patent No.: US 9,978,335 B2
(45) Date of Patent: May 22, 2018

(54) DISPLAY APPARATUS HAVING COLOR PIXEL DIAGONAL GROUP TO RECEIVE DATA VOLTAGES HAVING SAME POLARITY

(71) Applicant: Samsung Display Co., Ltd., Yongin-si, Gyeonggi-do (KR)

(72) Inventors: Jai-hyun Koh, Hwaseong-si (KR); Jin-kyu Park, Yongin-si (KR); Seokyun Son, Yongin-si (KR); Kuk-hwan Ahn, Hwaseong-si (KR); Joon-chul Goh, Hwaseong-si (KR); Bonghyun You, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days. days.

(21) Appl. No.: 15/064,428

(22) Filed: Mar. 8, 2016

(65) Prior Publication Data

US 2016/0372076 A1 Dec. 22, 2016

(30) Foreign Application Priority Data

Jun. 17, 2015 (KR) ..... 10-2015-0086025

(51) Int. Cl.
*G09G 3/36* (2006.01)

(52) U.S. Cl.
CPC ..... *G09G 3/3696* (2013.01); *G09G 3/3607* (2013.01); *G09G 3/3614* (2013.01);
(Continued)

(58) Field of Classification Search
CPC .. G09G 3/3607; G09G 3/2003; G09G 3/3614; G09G 3/3648; G09G 3/3696
(Continued)

(56) References Cited

U.S. PATENT DOCUMENTS 8,587,504 B2 11/2013 Joo
8,810,490 B2 * 8/2014 Moon ..... G09G 3/3607 345/84
(Continued)

FOREIGN PATENT DOCUMENTS

KR 2002-0045529 6/2002
KR 10-2008-0077807 8/2008
(Continued)

OTHER PUBLICATIONS

EPO Search Report dated Aug. 5, 2016 for corresponding European Patent application 16173273.0, (8 pages).

*Primary Examiner* — Adam J Snyder
(74) *Attorney, Agent, or Firm* — Lewis Roca Rothgerber Christie LLP

(57) ABSTRACT

A display apparatus includes gate lines extending in a first direction, data lines extending in a second direction crossing the first direction, first color pixels, and second color pixels. A first color pixel arranged in an f-th column between an f-th data line and an (f+1)th data line is connected to one of the f-th data line and the (f+1)th data line. A first color pixel arranged in a g-th column between a g-th data line and a (g+1)th data line is connected to one of a (g−1)th data line and a (g+2)th data line. First color pixels in a first color pixel diagonal group receive data voltages having a same polarity. Second color pixels in a second color pixel diagonal group receive data voltages having a same polarity.

9 Claims, 11 Drawing Sheets

(52) U.S. Cl.
CPC ... *G09G 3/3648* (2013.01); *G09G 2300/0426* (2013.01); *G09G 2300/0452* (2013.01); *G09G 2300/0823* (2013.01)

(58) Field of Classification Search
USPC ..... 345/88
See application file for complete search history.

(56) References Cited

U.S. PATENT DOCUMENTS

| | | | | |
|---|---|---|---|---|
| 2008/0284758 | A1* | 11/2008 | Lee | G09G 3/3688 345/87 |
| 2011/0156992 | A1* | 6/2011 | Moon | G09G 3/3607 345/84 |
| 2014/0111410 | A1* | 4/2014 | Guo | G09G 3/3607 345/87 |
| 2014/0111411 | A1* | 4/2014 | Guo | G09G 3/36 345/87 |
| 2014/0266995 | A1 | 9/2014 | Cho et al. | |
| 2015/0002376 | A1* | 1/2015 | Yang | G09G 3/3607 345/58 |
| 2015/0213784 | A1 | 6/2015 | Park et al. | |
| 2015/0213748 | A1 | 7/2015 | Park et al. | |

FOREIGN PATENT DOCUMENTS

| | | | |
|---|---|---|---|
| KR | 10-2011-0062619 | A | 6/2011 |
| KR | 10-2011-0064114 | | 6/2011 |
| KR | 10-2012-0058206 | A | 6/2012 |
| KR | 10-2013-0067923 | A | 6/2013 |
| KR | 10-2013-0121388 | A | 11/2013 |
| KR | 10-2014-0103588 | | 8/2014 |

* cited by examiner

DISPLAY APPARATUS HAVING COLOR PIXEL DIAGONAL GROUP TO RECEIVE DATA VOLTAGES HAVING SAME POLARITY

CROSS-REFERENCE TO RELATED APPLICATION

This U.S. non-provisional patent application claims priority to and the benefit of Korean Patent Application No. 10-2015-0086025, filed on Jun. 17, 2015, under 35 U.S.C. § 119, the content of which is hereby incorporated by reference in its entirety.

BACKGROUND

1. Field

One or more aspects of example embodiments of the present invention relate to a display apparatus. More particularly, one or more aspects of example embodiments of the present invention relate to a display apparatus that may be operated in an inversion driving scheme.

2. Description of the Related Art

A liquid crystal display forms an electric field in a liquid crystal layer disposed between two substrates, and changes an alignment of liquid crystal molecules of the liquid crystal layer to control a transmittance of light incident to the liquid crystal layer. Thus, a desired image is displayed through the liquid crystal display.

Methods of driving the liquid crystal display include a line inversion method, a column inversion method, and a dot inversion method according to a phase of a data voltage applied to the data line. The line inversion method inverts the phase of image data applied to data lines for every pixel row. The column inversion method inverts the phase of the image applied to the data lines for every pixel column. The dot inversion method inverts the phase of the image data applied to the data lines for every pixel row and every pixel column.

In general, a display apparatus may display colors by using three primary colors of red, green, and blue colors. Accordingly, the display apparatus includes sub-pixels respectively corresponding to the red, green, and blue colors. In recent years, a display apparatus that displays the colors using red, green, blue, and a primary color has been suggested. The primary color may be one or two or more of magenta, cyan, yellow, and/or white. In addition, a display apparatus including red, green, blue, and white sub-pixels has been developed to improve brightness of the image. Red, green, and blue image signals are applied to the display panel after being converted to red, green, blue, and white data signals.

The above information disclosed in this Background section is for enhancement of understanding of the background of the present invention, and therefore, it may contain information that does not constitute prior art.

SUMMARY

One or more aspects of embodiments of the present invention are directed toward a display apparatus capable of variously setting polarities of data voltages applied to pixels without changing arrangements of the polarities of the data voltages applied to data lines.

One or more aspects of embodiments of the present invention are directed toward a display apparatus capable of preventing or substantially preventing stripes from being observed in a diagonal direction.

According to an embodiment of the present invention, a display apparatus includes: a plurality of gate lines extending in a first direction; a plurality of data lines extending in a second direction crossing the first direction; and a plurality of pixels connected to the gate lines and the data lines, the plurality of pixels including: first color pixels configured to display a first color; and second color pixels configured to display a second color different from the first color, wherein a first color pixel from among the first color pixels arranged in an f-th (f is a natural number) column between an f-th data line and an (f+1)th data line is connected to one of the f-th data line and the (f+1)th data line, wherein a first color pixel from among the first color pixels arranged in a g-th (g is a natural number different from f) column between a g-th data line and a (g+1)th data line is connected to one of a (g−1)th data line and a (g+2)th data line, wherein first color pixels from among the first color pixels that are adjacent to each other in a third direction crossing the first and second directions form a first color pixel diagonal group, the first color pixels of the first color pixel diagonal group being configured to receive data voltages having a same polarity, and wherein second color pixels from among the second color pixels that are adjacent to each other in a fourth direction crossing the first, second, and third directions form a second color pixel diagonal group, the second color pixels of the second color pixel diagonal group being configured to receive data voltages having a same polarity.

The first color pixel diagonal group may include a plurality of first color pixel diagonal groups, the data voltages applied to the first color pixel diagonal groups that are adjacent to each other may have opposite polarities to each other, and the second color pixel diagonal group may include a plurality of second color pixel diagonal groups, the data voltages applied to the second color pixel diagonal groups adjacent to each other may have opposite polarities to each other.

The first color pixels included in a same one of the first color pixel diagonal groups may receive the data voltages having the same polarity, and the second color pixels included in a same one of the second color pixel diagonal groups may receive the data voltages having the same polarity.

The first color may be one of red and blue colors, and the second color may be the other one of the red and blue colors, or the first color may be one of white and green colors, and the second color may be the other one of the white and green colors.

The first color pixels of the first color pixel diagonal group may be located at positions satisfying a condition where a number of columns increases by 2 when a number of rows increases by 1, respectively, and the second color pixels of the second color pixel diagonal group may be located at positions satisfying a condition where the number of columns decreases by 2 when the number of rows increases by 1, respectively.

The first color pixels of the first color pixel diagonal group may be located at positions satisfying a condition where a number of columns increases by 1 when a number of rows increases by 2, respectively, and the second color pixels of the second color pixel diagonal group may be located at positions satisfying a condition where the number of columns decreases by 1 when the number of rows increases by 2, respectively.

The plurality of pixels may further include: third color pixels configured to display a third color different from the first and second colors; and fourth color pixels configured to display a fourth color different from the first, second, and third colors.

The first, second, third, and fourth colors may be red, blue, green, and white colors, respectively, the first, second, third, and fourth colors may be green, blue, red, and white colors, respectively, the first, second, third, and fourth colors may be red, white, green, and blue colors, respectively, or the first, second, third, and fourth colors may be green, white, red, and blue colors, respectively.

Pixels arranged in an h-th (h is a natural number) row and an (h+2)th row from among the plurality of pixels may be arranged in order of the first color pixel, the third color pixel, the second color pixel, and the fourth color pixel, and pixels arranged in an (h+1)th row and an (h+3)th row from among the plurality of pixels may be arranged in order of the second color pixel, the fourth color pixel, the first color pixel, and the third color pixel.

Pixels arranged in an h-th (h is a natural number) column and an (h+2)th column from among the plurality of pixels may be arranged in order of the first color pixel, the third color pixel, the second color pixel, and the fourth color pixel, and pixels arranged in an (h+1)th column and an (h+3)th column from among the plurality of pixels may be arranged in order of the second color pixel, the fourth color pixel, the first color pixel, and the third color pixel.

The display apparatus may further include: a red-green pixel group including the first color pixel arranged between a y-th (y is a natural number) data line and a (y+1)th data line from among the data lines, and the third color pixel arranged between the (y+1)th data line and a (y+2)th data line from among the data lines and adjacent to the first color pixel in the first direction; and a blue-white pixel group including the second color pixel arranged between a j-th (j is a natural number) data line and a (j+1)th data line from among the data lines, and the fourth color pixel arranged between the (j+1)th data line and a (j+2)th data line from among the data lines and adjacent to the second color pixel in the first direction.

The red-green pixel group may include: a first red-green pixel group including the first color pixel connected to the y-th data line and the third color pixel connected to the (y+1)th data line; and a second red-green pixel group including the first color pixel connected to the (y+1)th data line and the third color pixel connected to the y-th data line; and the blue-white pixel group may include: a first blue-white pixel group including the second color pixel connected to the j-th data line and the fourth color pixel connected to the (j+1)th data line; and a second blue-white pixel group including the second color pixel connected to the (j+1)th data line and the fourth color pixel connected to the j-th data line.

The red-green pixel group may further include: a third red-green pixel group including the first color pixel connected to the (y+1)th data line and the third color pixel connected to the (y+2)th data line; and a fourth red-green pixel group including the first color pixel connected to the (y+2)th data line and the third color pixel connected to the (y+1)th data line; and the blue-white pixel group may further include: a third blue-white pixel group including the second color pixel connected to the (j+1)th data line and the fourth color pixel connected to the (j+2)th data line; and a fourth blue-white pixel group including the second color pixel connected to the (j+2)th data line and the fourth color pixel connected to the (j+1)th data line.

The red-green pixel group may include: a first red-green pixel group including the first color pixel connected to the y-th data line and the third color pixel connected to the (y+1)th data line; a second red-green pixel group including the first color pixel connected to the y-th data line and the third color pixel connected to the (y+2)th data line; a third red-green pixel group including the first color pixel connected to a (y−1)th data line and the third color pixel connected to the (y+1)th data line; and a fourth red-green pixel group including the first color pixel connected to the (y−1)th data line and the third color pixel connected to the (y+2)th data line; and the blue-white pixel group may include: a first blue-white pixel group including the second color pixel connected to the j-th data line and the fourth color pixel connected to the (j+1)th data line; a second blue-white pixel group including the second color pixel connected to a (j-1)th data line and the fourth color pixel connected to the (j+2)th data line; a third blue-white pixel group including the second color pixel connected to the j-th data line and the fourth color pixel connected to the (j+2)th data line; and a fourth blue-white pixel group including the second color pixel connected to the (j−1)th data line and the fourth color pixel connected to the (j+1)th data line.

The red-green pixel group may further include: a fifth red-green pixel group including the first color pixel connected to the (y+1)th data line and the third color pixel connected to a (y+3)th data line; and a sixth red-green pixel group including the first color pixel connected to the y-th data line and the third color pixel connected to the (y+3)th data line; and the blue-white pixel group may further include: a fifth blue-white pixel group including the second color pixel connected to the j-th data line and the fourth color pixel connected to a (j+3)th data line; and a sixth blue-white pixel group including the second color pixel connected to the (j+1)th data line and the fourth color pixel connected to the (j+3)th data line.

The display apparatus may further include: a red-green pixel group including the first and third color pixels arranged between a y-th (y is a natural number) data line and a (y+1)th data line from among the data lines, the first and third color pixels being adjacent to each other in the second direction; and a blue-white pixel group including the second and fourth color pixels arranged between a j-th (j is a natural number) data line and a (j+1)th data line from among the data lines, the second and fourth color pixels being adjacent to each other in the second direction.

The red-green pixel group may include: a first red-green pixel group including the first and third color pixels connected to the y-th data line; a second red-green pixel group including the first and third color pixels connected to a (y−1)th data line; and a third red-green pixel group including the first and third color pixels connected to the (y+1)th data line; and the blue-white pixel group may include: a first blue-white pixel group including the second and fourth color pixels connected to the j-th data line; a second blue-white pixel group including the second and fourth color pixels connected to a (j−1)th data line; and a third blue-white pixel group including the second and fourth color pixels connected to the (j+1)th data line.

According to an embodiment of the present invention, a display apparatus includes: a plurality of gate lines extending in a first direction; a plurality of data lines extending in a second direction crossing the first direction; and first, second, third, and fourth color pixels connected to the gate lines and the data lines and configured to display different colors from each other, wherein a first color pixel arranged in an f-th (f is a natural number) column between an f-th data line and an (f+1)th data line from among the first color pixels is connected to one of the f-th data line and the (f+1)th data line, wherein a first color pixel arranged in a g-th (g is a natural number different from f) column between a g-th data line and a (g+1)th data line from among the first color pixels is connected to one of a (g−1)th data line and a (g+2)th data line, and wherein the first color pixel arranged in the f-th column and the first color pixel arranged in the g-th column are arranged in a same row facing each other with corresponding ones of the second, third, and fourth color pixels arranged therebetween.

First color pixels arranged adjacent to each other in a third direction crossing the first and second directions may form a first color pixel diagonal group, wherein the first color pixel diagonal group may include a plurality of first color pixel diagonal groups, the first color pixels in a same one of the first color pixel diagonal groups being configured to receive data voltages having a same polarity, wherein second color pixels arranged adjacent to each other in a fourth direction crossing the first, second, and third directions may form a second color pixel diagonal group, and wherein the second color pixel diagonal group may include a plurality of second color pixel diagonal groups, the second color pixels in a same one of the second color pixel diagonal groups being configured to receive data voltages having a same polarity.

The first color may be one of red and blue colors, and the second color may be the other one of the red and blue colors, or the first color may be one of white and green colors and the second color may be the other one of the white and green colors.

According to one or more embodiments of the present invention, the polarities of the data voltages applied to the pixels may be changed in various ways without changing the arrangements of the polarities of the data voltages applied to the data lines.

In addition, according to one or more embodiments of the present invention, a display apparatus may prevent or substantially prevent stripes from being observed in the diagonal direction.

BRIEF DESCRIPTION OF THE DRAWINGS

The above and other aspects and features of the present invention will become readily apparent by reference to the following detailed description when considered in conjunction with the accompanying drawings wherein.

DETAILED DESCRIPTION

Figure 1:
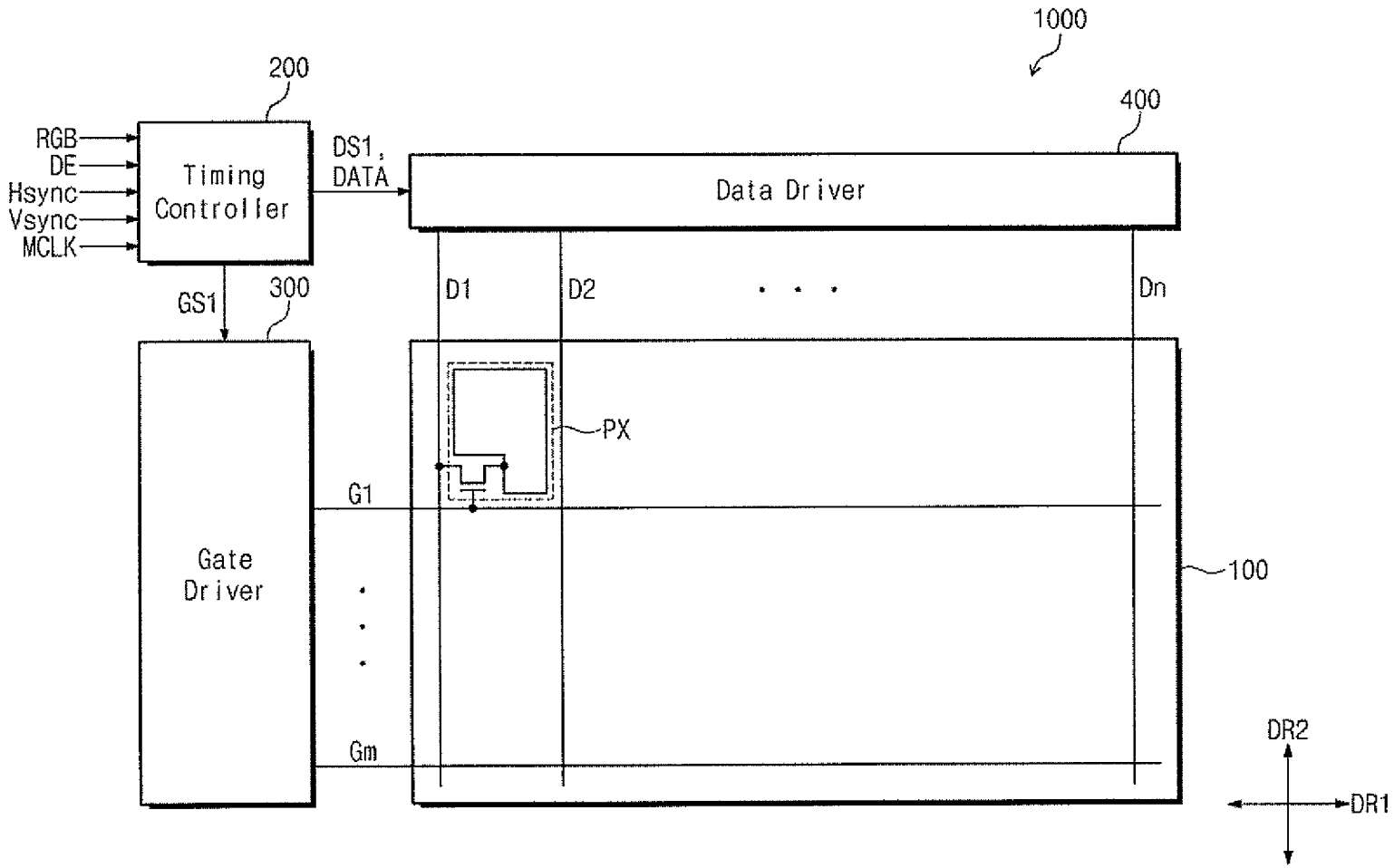
FIG. 1 is a block diagram showing a liquid crystal display according to an exemplary embodiment of the present invention.

Hereinafter, exemplary embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated.

In the drawings, the relative sizes of elements, layers, and regions may be exaggerated for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features, Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," "coupled to," or "adjacent to" another element or layer, it can be directly on, connected to, coupled to, or adjacent to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, exemplary embodiments of the present invention will be described in more detail with reference to the accompanying drawings.

Figure 2:
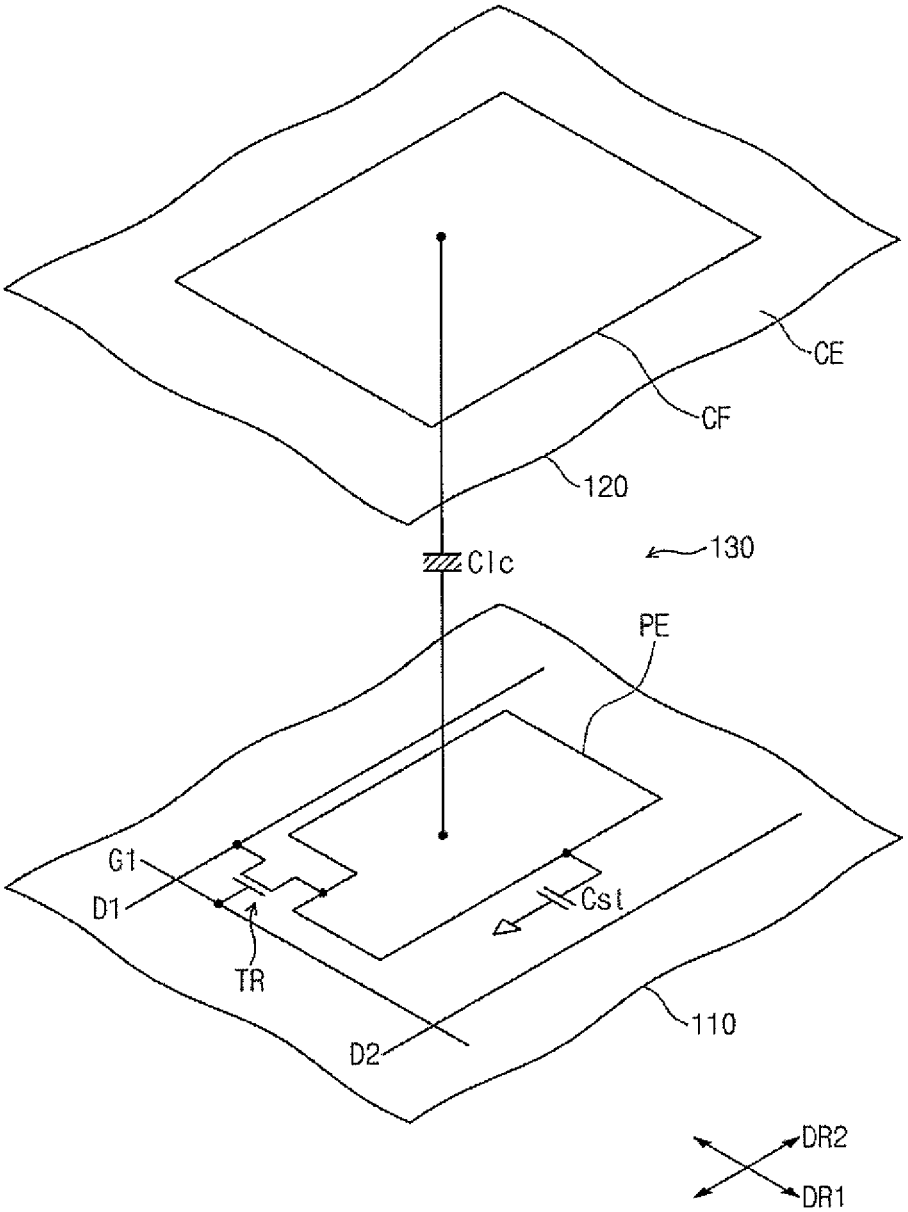
FIG. 2 is an equivalent circuit diagram of one pixel shown in FIG. 1.

FIG. 1 is a block diagram showing a liquid crystal display 1000 according to an exemplary embodiment of the present invention, and FIG. 2 is an equivalent circuit diagram of one pixel shown in FIG. 1.

Referring to FIGS. 1 and 2, the liquid crystal display 1000 includes a liquid crystal panel 100, a timing controller 200, a gate driver 300, and a data driver 400.

The liquid crystal panel 100 includes a lower substrate 110, an upper substrate 120 facing the lower substrate 110, and a liquid crystal layer 130 between the lower substrate 110 and the upper substrate 120.

The liquid crystal panel 100 includes a plurality of gate lines G1 to Gm extending in a first direction DR1, and a plurality of data lines D1 to Dn extending in a second direction DR2 crossing the first direction DR1. The gate lines G1 to Gm and the data lines D1 to Dn define pixel areas, and pixels are arranged in the pixel areas, respectively. FIG. 1 shows a pixel PX connected to a first gate line G1 and a first data line D1.

The pixel PX includes a thin film transistor TR, a liquid crystal capacitor Clc, and a storage capacitor Cst. The thin film transistor TR is connected to one of the gate lines G1 to Gm and one of the data lines D1 to Dn. The liquid crystal capacitor Clc is connected to the thin film transistor TR. The storage capacitor Cst is connected to the liquid crystal capacitor Clc in parallel. The storage capacitor Cst may be omitted.

The thin film transistor TR is arranged on (e.g., under) the lower substrate 110. The thin film transistor TR may be a three-terminal device including a control terminal, a first terminal, and a second terminal. The control terminal of the thin film transistor TR is connected to a corresponding gate line (e.g., the first gate line G1), the first terminal of the thin film transistor TR is connected to a corresponding data line (e.g., the first data line D1), and the second terminal of the thin film transistor TR is connected to the liquid crystal capacitor Clc and the storage capacitor Cst.

The liquid crystal capacitor Clc includes a pixel electrode PE arranged on the lower substrate 110, and a common electrode CE arranged on the upper substrate 120 as its two terminals, and the liquid crystal layer 130 arranged between the pixel electrode PE and the common electrode CE serves as a dielectric substance. The pixel electrode PE is connected to the thin film transistor TR, and the common electrode CE is arranged on an entire surface of the upper substrate 120 to receive a common voltage. However, the present invention is not limited thereto, and according to another exemplary embodiment, the common electrode CE may be arranged on the lower substrate 110, and in this case, at least one of the pixel electrode PE and the common electrode CE may include slits.

The storage capacitor Cst assists the liquid crystal capacitor Clc and includes the pixel electrode PE, a storage line, and an insulating layer between the pixel electrode PE and the storage line. The storage line is arranged on the lower substrate 110 to overlap with a portion of the pixel electrode PE. The storage line receives a constant voltage (e.g., a storage voltage).

The pixel PX displays one of primary colors. The primary colors include red, green, blue, and white colors, but are not limited thereto or thereby. For example, the primary colors may further include various colors, e.g., cyan, magenta, yellow, etc. In the present exemplary embodiment, the pixel PX includes red, green, blue, and white pixels.

The pixel PX may further include a color filter CF corresponding to one of the primary colors. In FIG. 2, the color filter CF is arranged on the upper substrate 120, but the present invention is not limited thereto or thereby. For example, according to another exemplary embodiment, the color filter CF may be arranged on the lower substrate 110.

The timing controller 200 receives image data RGB and control signals from an external graphic controller. The control signals may include a vertical synchronization signal as a frame distinction signal Vsync, a horizontal synchronization signal as a row distinction signal Hsync, a data enable signal DE maintained or substantially maintained at a high level during a period when data is output to indicate a data input period, and a main clock signal MCLK.

The timing controller 200 converts the image data RGB according to specifications of the data driver 400. The timing controller 200 applies the converted image data DATA to the data driver 400. The timing controller 200 generates a gate control signal GS1 and a data control signal DS1. The gate control signal GS1 is applied to the gate driver 300, and the data control signal DS1 is applied to the data driver 400.

The gate control signal GS1 is used to drive the gate driver 300, and the data control signal DS1 is used to drive the data driver 400.

The gate driver 300 generates gate signals in response to the gate control signal GS1, and applies the gate signals to the gate lines G1 to Gm. The gate control signal GS1 may include a scan start signal for indicating a start of scanning, at least one clock signal for controlling an output period of a gate on voltage, and an output enable signal for controlling the maintaining of the gate on voltage.

The data driver 400 generates grayscale (e.g., gray level) voltages corresponding to the image data DATA in response to the data control signal DS1, and applies the grayscale (e.g., gray level) voltages to the data lines D1 to Dn as data voltages. The data voltages include a positive (+) data voltage having a positive value with respect to the common voltage, and a negative (−) data voltage having a negative value with respect to the common voltage. The data control signal DS1 may include a horizontal start signal STH for indicating a start of transmitting of the image data DATA to the data driver 400, a load signal for indicating application of the data voltages to the data lines D1 to Dn, and an inversion signal for inverting a polarity of the data voltages with respect to the common voltage.

The polarity of the data voltages applied to the pixels PX is inverted after one frame period is finished and before a next frame period starts to prevent or protect the liquid crystals from burning and/or from deteriorating. For example, the data driver 400 inverts the polarity of the data voltages every frame period in response to the inversion signal. In addition, when an image corresponding to one frame is displayed through the liquid crystal panel 100, the data voltages having different polarities are output in a unit of at least one data line, and applied to the pixels to improve display quality.

The data driver 400 alternately outputs the positive (+) data voltage and the negative (−) data voltage every one data line.

Each of the timing controller 200, the gate driver 300, and the data driver 400 may be directly mounted on the liquid crystal panel 100, attached to the liquid crystal panel 100 in a tape carrier package after being mounted on a flexible printed circuit board, or mounted on a separate printed circuit board. In another example, at least one of the gate driver 300 and the data driver 400 may be integrated on the liquid crystal panel 100 together with the gate lines G1 to Gm, the data lines D1 to Dn, and the thin film transistor TR. Alternatively, the timing controller 200, the gate driver 300, and the data driver 400 may be integrated in a single chip.

Figure 3:
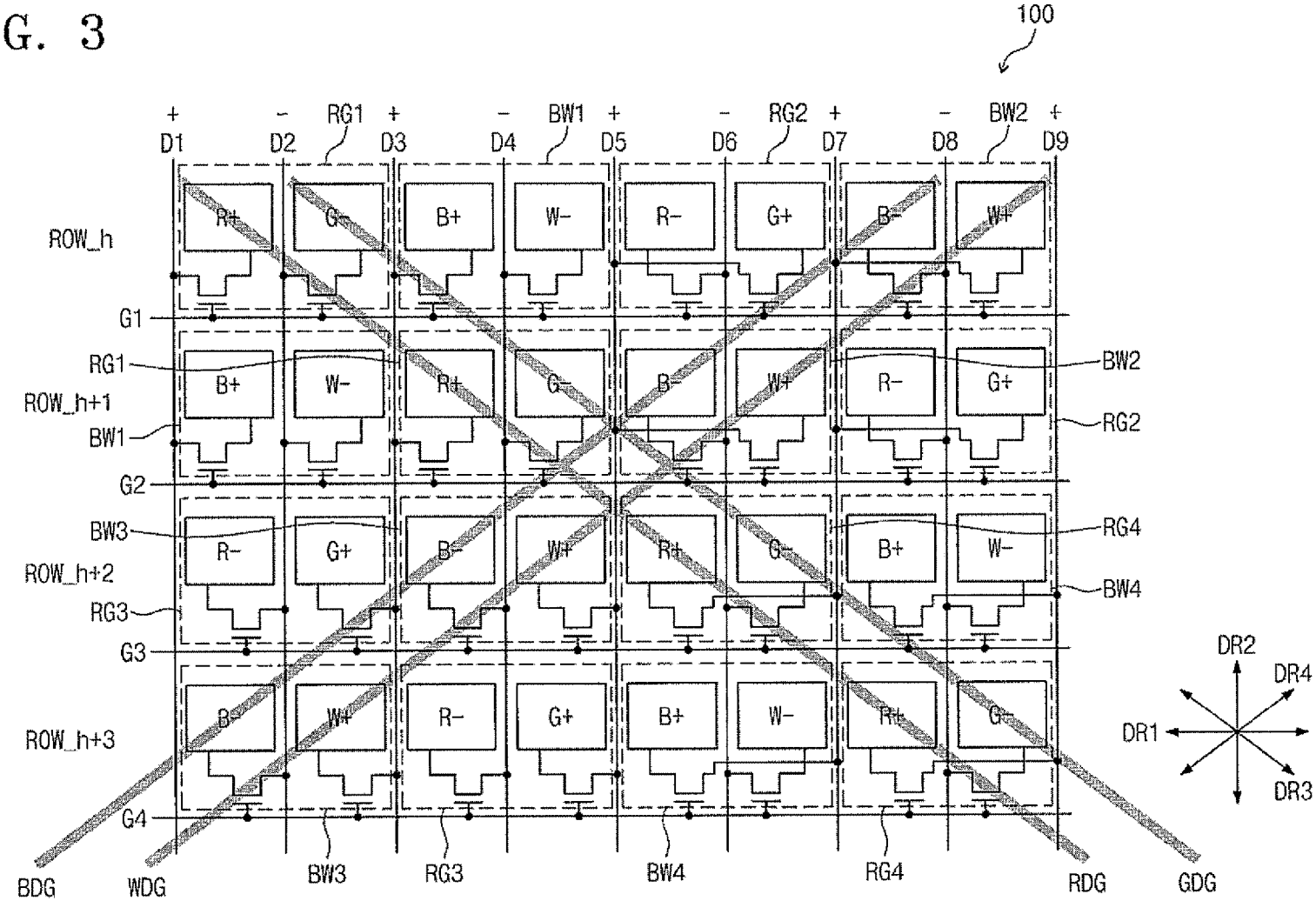
FIG. 3 is a plan view showing a portion of a liquid crystal panel according to an exemplary embodiment of the present invention.

FIG. 3 is a plan view showing a portion of the liquid crystal panel 100 according to an exemplary embodiment of the present invention.

In FIG. 3, the red, green, blue, and white pixels are indicated by "R", "G", "B", and "W", respectively. The pixels applied with the data voltages having the positive (+) polarity are represented by "R+", "G+", "B+", and "W+", respectively, and the pixels applied with the data voltages having the negative (−) polarity are represented by "R−", "G−", "B−", and "W−", respectively.

Hereinafter, a position of each pixel may be referred to by a row and a column. For example, the red pixel connected to the first gate line G1 and the first data line D1 is arranged at a first row and a first column.

The row index increases from top to bottom in the figures, and the column index increases from left to right in the figures.

The polarities of the data voltages applied to the pixels of the liquid crystal panel 100 shown in FIG. 3 indicate polarities of the data voltages in an i-th frame period. The polarities of the data voltages are inverted in an (i+1)th frame period. That is, the data driver 400 shown in FIG. 1 inverts the polarities of the data voltages applied to the data lines D1 to Dn at every frame period. For example, the data voltages having the positive polarity and the data voltages having the negative polarity are alternately applied to the data lines D1 to D9.

The pixels arranged in an h-th (h is a natural number) row ROW_h and an (h+2)th row ROW_h+2 are repeatedly arranged in order of red, green, blue, and white pixels. The pixels arranged in an (h+1)th row ROW_h+1 and an (h+3)th row ROW_h+3 are repeatedly arranged in order of blue, white, red, and green pixels. In the exemplary embodiment shown in FIG. 3, the "h" may refer to an odd number, but the "h" may refer to an even number according to other embodiments.

Further, according to some embodiments, the positions of the red and green pixels may be changed with respect to each other. In addition, positions of the blue and white pixels may be changed with respect to each other. According to another exemplary embodiment, the pixels arranged in the h-th row ROW_h and the (h+2)th row ROW_h+2 are repeatedly arranged in order of green, red, blue, and white pixels, and the pixels arranged in the (h+1)th row ROW_h+1 and the (h+3)th row ROW_h+3 are repeatedly arranged in order of blue, white, green, and red pixels. According to another exemplary embodiment, the pixels arranged in the h-th row ROW_h and the (h+2)th row ROW_h+2 are repeatedly arranged in order of green, red, white, and blue pixels, and the pixels arranged in the (h+1)th row ROW_h+1 and the (h+3)th row ROW_h+3 are repeatedly arranged in order of white, blue, green, and red pixels. According to another exemplary embodiment, the pixels arranged in the h-th row ROW_h and the (h+2)th row ROW_h+2 are repeatedly arranged in order of red, green, white, and blue pixels, and the pixels arranged in the (h+1)th row ROW_h+1 and the (h+3)th row ROW_h+3 are repeatedly arranged in order of white, blue, red, and green pixels.

Among the pixels having the same color, e.g., red pixels, one pixel arranged between an f-th (f is a natural number satisfying the condition of $1 \le f \le n-1$) data line and an (f+1)th data line may be connected to one of the f-th data line and the (f+1)th data line. In this case, among the red pixels, one pixel arranged between a g-th (g is a natural number satisfying the condition of $1 \le g \le n-2$ and $g \ne f$) data line and a (g−1)th data line is connected to one of a (g−1)th data line and a (g+2)th data line.

In FIG. 3, the red pixels arranged between the first and second data lines D1 and D2 are connected to one of the first and second data lines D1 and D2. The red pixels arranged between fifth and sixth data lines D5 and D6 and connected to a third gate line G3 or a fourth gate line G4 are connected to a seventh data line D7. The arrangement and connection structures of the red pixels may be applied to the green, blue, and white pixels.

The liquid crystal panel 100 includes a red-green pixel group and a blue-white pixel group. The red-green pixel group includes the red pixel and the green pixel adjacent to the red pixel in the first direction DR1. As shown in FIG. 3, the red pixel is located at a left position in the red-green pixel group and the green pixel is located at a right position, but are not limited thereto or thereby. That is, the green pixel may be located at the left position and the red pixel may be located at the right position.

The blue-white pixel group includes the blue pixel and the white pixel adjacent to the blue pixel in the first direction DR1. As shown in FIG. 3, the blue pixel is located at a left position in the blue-white pixel group and the white pixel is located at a right position, but are not limited thereto or thereby. That is, the white pixel may be located at the left position and the blue pixel may be located at the right position.

Each of the red-green pixel group and the blue-white pixel group is applied with a data voltage generated from a basic unit of the image data RGB including red, green, and blue data.

The red-green pixel group and the blue-white pixel group are alternately arranged with each other in the first and second directions DR1 and DR2.

The red-green pixel group includes first to fourth red-green pixel groups RG1 to RG4. Each of the first to fourth red-green pixel groups RG1 to RG4 includes the red pixel arranged between a y-th (y is a natural number) data line and a (y+1)th data line, and the green pixel arranged between the (y+1)th data line and a (y+2)th data line.

Hereinafter, the first red-green pixel group refers to the red-green pixel group RG1 including the red pixel connected to the y-th data line and the green pixel connected to the (y+1)th data line.

Hereinafter, the second red-green pixel group refers to the red-green pixel group RG2 including the red pixel connected to the (y+1)th data line and the green pixel connected to the y-th data line.

Hereinafter, the third red-green pixel group refers to the red-green pixel group RG3 including the red pixel connected to the (y+1)th data line and the green pixel connected to the (y+2)th data line.

Hereinafter, the fourth red-green pixel group refers to the red-green pixel group RG4 including the red pixel connected to the (y+2)th data line and the green pixel connected to the (y+1)th data line.

The blue-white pixel group includes first to fourth blue-white pixel groups BW1 to BW4. Each of the first to fourth blue-white pixel groups BW1 to BW4 includes the blue pixel arranged between a j-th (j is a natural) data line and a (j+1)th data line, and the white pixel arranged between the (j+1)th data line and a (j+2)th data line.

Hereinafter, the first blue-white pixel group refers to the blue-white pixel group BW1 including the blue pixel connected to the j-th data line and the white pixel connected to the (j+1)th data line.

Hereinafter, the second blue-white pixel group refers to the blue-white pixel group BW2 including the blue pixel connected to the (j+1)th data line and the white pixel connected to the j-th data line.

Hereinafter, the third blue-white pixel group refers to the blue-white pixel group BW3 including the blue pixel connected to the (j+1)th data line and the white pixel connected to the (j+2)th data line.

Hereinafter, the fourth blue-white pixel group refers to the blue-white pixel group BW4 including the blue pixel connected to the (j+2)th data line and the white pixel connected to the (j+1)th data line.

In the present exemplary embodiment shown in FIG. 3, the first red-green pixel group RG1, the first blue-white pixel group BW1, the second red-green pixel group RG2, and the second blue-white pixel group BW2 are sequentially and repeatedly arranged in the h-th row ROW_h of the liquid crystal panel 100.

The first blue-white pixel group BW1, the first red-green pixel group RG1, the second blue-white pixel group BW2, and the second red-green pixel group RG2 are sequentially and repeatedly arranged in the (h+1)th row ROW_h+1 of the liquid crystal panel 100.

The third red-green pixel group RG3, the third blue-white pixel group BW3, the fourth red-green pixel group RG4, and the fourth blue-white pixel group BW4 are sequentially and repeatedly arranged in the (h+2)th row ROW_h+2 of the liquid crystal panel 100.

The third blue-white pixel group BW3, the third red-green pixel group RG3, the fourth blue-white pixel group BW4, and the fourth red-green pixel group RG4 are sequentially and repeatedly arranged in the (h+3)th row ROW_h+3 of the liquid crystal panel 100.

The liquid crystal panel 100 includes a red pixel diagonal group RDG, a green pixel diagonal group GDG, a blue pixel diagonal group BDG, and a white pixel diagonal group WDG.

The red pixel diagonal group RDG includes the red pixels located at positions satisfying the condition that a number of columns increases by 2 when a number of rows increases by 1. As shown in FIG. 3, the red pixel diagonal group RDG includes the red pixel arranged at the position of the first row and the first column, the red pixel arranged at the position of the second row and the third column, the red pixel arranged at the position of the third row and the fifth column, and the red pixel arranged at the position of the fourth row and the seventh column.

The red pixels included in a same red pixel diagonal group RDG are applied with the data voltages having the same polarity. For example, the red pixel arranged at the position of the first row and the first column, the red pixel arranged at the position of the second row and the third column, the red pixel arranged at the position of the third row and the fifth column, and the red pixel arranged at the position of the fourth row and the seventh column shown in FIG. 3 are applied with the positive (+) data voltages.

The green pixel diagonal group GDG includes the green pixels located at positions satisfying the condition that the number of columns increases by 2 when the number of rows increases by 1. As shown in FIG. 3, the green pixel diagonal group GDG includes the green pixel arranged at the position of the first row and the second column, the green pixel arranged at the position of the second row and the fourth column, the green pixel arranged at the position of the third row and the sixth column, and the green pixel arranged at the position of the fourth row and the eighth column.

The green pixels included in a same green pixel diagonal group GDG are applied with the data voltages having the same polarity. For example, the green pixel arranged at the position of the first row and the second column, the green pixel arranged at the position of the second row and the fourth column, the green pixel arranged at the position of the third row and the sixth column, and the green pixel arranged at the position of the fourth row and the eighth column shown in FIG. 3 are applied with the negative (−) data voltages.

The blue pixel diagonal group BDG includes the blue pixels located at positions satisfying the condition that the number of columns decreases by 2 when the number of rows increases by 1. As shown in FIG. 3, the blue pixel diagonal group BDG includes the blue pixel arranged at the position of the first row and the seventh column, the blue pixel arranged at the position of the second row and the fifth column, the blue pixel arranged at the position of the third row and the third column, and the blue pixel arranged at the position of the fourth row and the first column.

The blue pixels included in a same blue pixel diagonal group BDG are applied with the data voltages having the same polarity. For example, the blue pixel arranged at the position of the first row and the seventh column, the blue pixel arranged at the position of the second row and the fifth column, the blue pixel arranged at the position of the third row and the third column, and the blue pixel arranged at the position of the fourth row and the first column shown in FIG. 3 are applied with the negative (−) data voltages.

The white pixel diagonal group WDG includes the white pixels located at positions satisfying the condition that the number of columns decreases by 2 when the number of rows increases by 1. As shown in FIG. 3, the white pixel diagonal group WDG includes the white pixel arranged at the position of the first row and the eighth column, the white pixel arranged at the position of the second row and the sixth column, the white pixel arranged at the position of the third row and the fourth column, and the white pixel arranged at the position of the fourth row and the second column.

The white pixels included in a same white pixel diagonal group WDG are applied with the data voltages having the same polarity. For example, the white pixel arranged at the position of the first row and the eighth column, the white pixel arranged at the position of the second row and the sixth column, the white pixel arranged at the position of the third row and the fourth column, and the white pixel arranged at the position of the fourth row and the second column shown in FIG. 3 are applied with the positive (+) data voltages.

Each of the red pixel diagonal group RDG, the green pixel diagonal group GDG, the blue pixel diagonal group BDG, and the white pixel diagonal group WDG is provided in a plurality of respective diagonal groups. The red pixel diagonal groups RDG adjacent to each other are applied with the data voltages having opposite polarities. For example, the red pixel diagonal group RDG including the red pixel (R+) arranged at the position of the first row and the first column, the red pixel (R+) arranged at the position of the second row and the third column, the red pixel (R+) arranged at the position of the third row and the fifth column, and the red pixel (R+) arranged at the position of the fourth row and the seventh column receives the data voltages having the positive (+) polarity, while the red pixel diagonal group including the red pixel (R−) arranged at the position of the first row and the fifth column and the red pixel (R−) arranged at the position of the second row and the seventh column receives the data voltages having the negative (−) polarity.

Similarly, the blue pixel diagonal groups BDG adjacent to each other receive the data voltages having opposite polarities, the green pixel diagonal groups GDG adjacent to each other receive the data voltages having opposite polarities, and the white pixel diagonal groups WDG adjacent to each other receive the data voltages having opposite polarities.

The red pixels of the red pixel diagonal group RDG are arranged in a direction different from a direction in which the blue pixels of the blue pixel diagonal group BDG are arranged. For example, the red pixels of the red pixel diagonal group RDG are arranged in a third direction DR3, while the blue pixels of the blue pixel diagonal group BDG are arranged in a fourth direction DR4. The third direction DR3 crosses the fourth direction DR4, and crosses the first and second directions DR1 and DR2.

The green pixels of the green pixel diagonal group GDG are arranged in a direction different from a direction in which the white pixels of the white pixel diagonal group WDG are arranged. For example, the green pixels of the green pixel diagonal group GDG are arranged in the third direction DR3, while the white pixels of the white pixel diagonal group WDG are arranged in the fourth direction DR4.

In general, human eyes may be more sensitive to certain colors than to other colors. For example, human eyes may be more sensitive to the white and green colors than to the red and blue colors. Thus, when pixels having a specific color are consecutively arranged in one direction, a stripe pattern image may be observed.

Since the red pixels of the same red pixel diagonal group RDG receive the data voltages having the same polarity, the stripe pattern image may be observed, and since the blue pixels of the same blue pixel diagonal group BDG receive the data voltages having the same polarity, the stripe pattern image may be observed. According to one or more of the exemplary embodiments of the present invention, the direction in which the red pixels of the red pixel diagonal group RDG are arranged is different from the direction in which the blue pixels of the blue pixel diagonal group BDG are arranged, and thus, a red stripe pattern may be offset against a blue stripe pattern. That is, when the liquid crystal panel 100 displays the red and blue colors together with each other, the red and blue stripe patterns may be prevented or substantially prevented from being observed in the diagonal directions.

Similarly, since the green pixels of the same green pixel diagonal group GDG receive the data voltages having the same polarity, the stripe pattern image may be observed, and since the white pixels of the same white pixel diagonal group WDG receive the data voltages having the same polarity, the stripe pattern image may be observed. According to one or more of the exemplary embodiments of the present invention, the direction in which the green pixels of the green pixel diagonal group GDG are arranged is different from the direction in which the white pixels of the white pixel diagonal group WDG are arranged, and thus, a green stripe pattern may be offset against a white stripe pattern. That is, when the liquid crystal panel 100 displays the green and white colors together with each other, the green and white stripe patterns may be prevented or substantially prevented from being observed in the diagonal directions.

The pixels adjacent to each other in the first direction DR1 and having the same color receive the data voltages having different polarities. In other words, the pixels having the same color that are adjacent to each other in the first direction DR1, such that three pixels are arranged therebetween, receive the data voltages having different polarities. For example, the red pixel (R+) arranged at the first row and first column receives the positive (+) data voltage, and the red pixel (R−) arranged at the first row and fifth column receives the negative (−) data voltage.

The polarity of the data voltages respectively applied to the pixels arranged in the same row is inverted in the unit of four pixels. For example, in the liquid crystal panel 100 shown in FIG. 3, the polarities of the data voltages applied to earlier four pixels (e.g., pixels arranged in the first to fourth columns) from among the pixels arranged in the h-th row ROW_h and the (h+1)th row ROW_h+1 are +, −, +, and −, respectively, and the polarities of the data voltages applied to later four pixels (e.g., pixels arranged in the fifth to eighth columns) following the earlier four pixels from among the pixels arranged in the h-th row ROW_h and the (h+1)th row ROW_h+1 are −, +, −, and +, respectively. In addition, the polarities of the data voltages applied to earlier four pixels (e.g., pixels arranged in the first to fourth columns) from among the pixels arranged in the (h+2)th row ROW_h+2 and the (h+3)th row ROW_h+3 are −, +, −, and +, respectively, and the polarities of the data voltages applied to later four pixels (e.g., pixels arranged in the fifth to eighth columns) following the earlier four pixels from among the pixels arranged in the (h+2)th row ROW_h+2 and the (h+3)th row ROW_h+3 are +, −, +, and −, respectively.

According to the present exemplary embodiment, the polarities of the data voltages applied to the pixels may be changed in various ways in accordance with the arrangements of the first to fourth red-green pixel groups RG1 to RG4 and the first to fourth blue-white pixel groups BW1 to BW4, without changing the arrangement of the polarities of the data voltages applied to the data lines.

Figure 4:
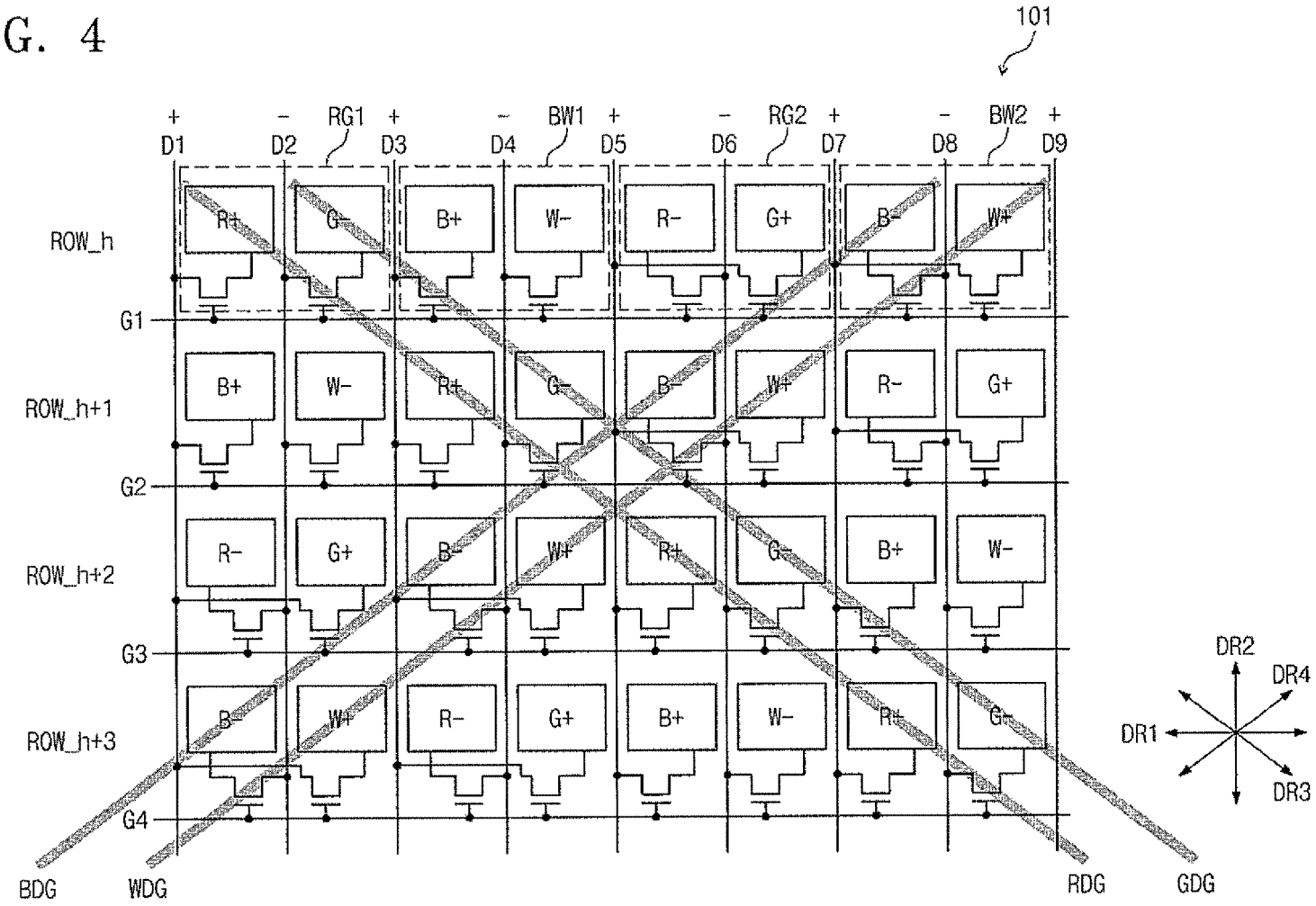
FIGS. 4 to 11 are plan views showing liquid crystal panels according to one or more exemplary embodiments of the present invention.

FIG. 4 is a plan view showing a portion of a liquid crystal panel 101 according to an exemplary embodiment of the present invention.

Hereinafter, different features between the liquid crystal panel 101 shown in FIG. 4 and the liquid crystal panel 100 shown in FIG. 3 will be mainly described.

Referring to FIG. 4, the first red-green pixel group RG1, the first blue-white pixel group BW1, the second red-green pixel group RG2, and the second blue-white pixel group BW2 are sequentially and repeatedly arranged in the h-th row ROW_h of the liquid crystal panel 101.

The first blue-white pixel group BW1, the first red-green pixel group RG1, the second blue-white pixel group BW2, and the second red-green pixel group RG2 are sequentially and repeatedly arranged in the (h+1)th row ROW_h+1 of the liquid crystal panel 101.

The second red-green pixel group RG2, the second blue-white pixel group BW2, the first red-green pixel group RG1, and the first blue-white pixel group BW1 are sequentially and repeatedly arranged in the (h+2)th row ROW_h+2 of the liquid crystal panel 101.

The second blue-white pixel group BW2, the second red-green pixel group RG2, the first blue-white pixel group BW1, and the first red-green pixel group RG1 are sequentially and repeatedly arranged in the (h+3)th row ROW_h+3 of the liquid crystal panel 101.

According to the present exemplary embodiment, the polarities of the data voltages applied to the pixels may be changed in various ways in accordance with the arrangements of the first and second red-green pixel groups RG1 and RG2 and the first and second blue-white pixel groups BW1 and BW2, without changing the arrangement of the polarities of the data voltages applied to the data lines.

Figure 5:
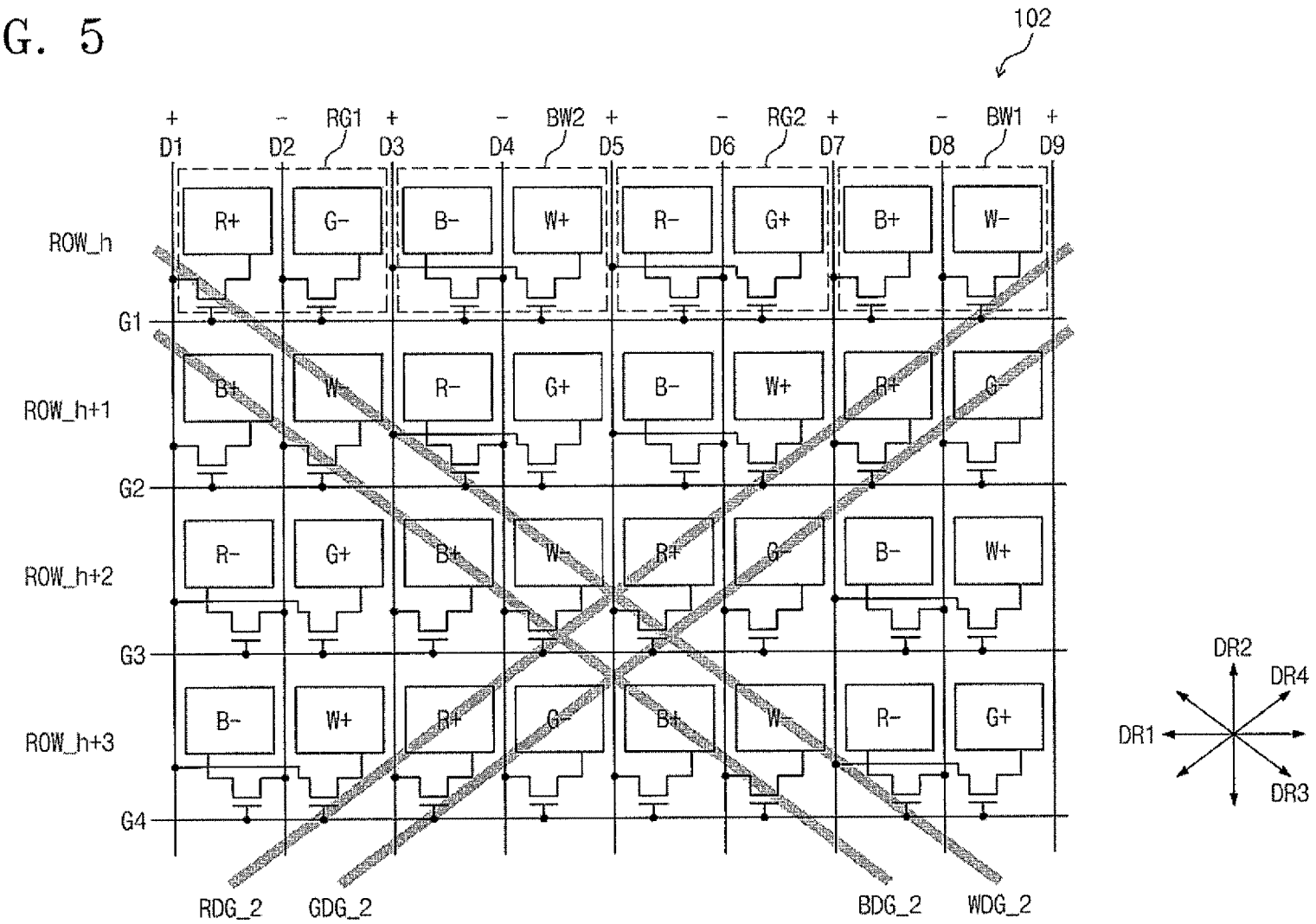

FIG. 5 is a plan view showing a portion of a liquid crystal panel 102 according to an exemplary embodiment of the present invention.

Hereinafter, different features between the liquid crystal panel 102 shown in FIG. 5 and the liquid crystal panel 100 shown in FIG. 3 will be mainly described.

Referring to FIG. 5, the first red-green pixel group RG1, the second blue-white pixel group BW2, the second red-green pixel group RG2, and the first blue-white pixel group BW1 are sequentially and repeatedly arranged in the h-th row ROW_h of the liquid crystal panel 102.

The first blue-white pixel group BW1, the second red-green pixel group RG2, the second blue-white pixel group BW2, and the first red-green pixel group RG1 are sequentially and repeatedly arranged in the (h+1)th row ROW_h+1 of the liquid crystal panel 102.

The second red-green pixel group RG2, the first blue-white pixel group BW1, the first red-green pixel group RG1, and the second blue-white pixel group BW2 are sequentially and repeatedly arranged in the (h+2)th row ROW_h+2 of the liquid crystal panel 102.

The second blue-white pixel group BW2, the first red-green pixel group RG1, the first blue-white pixel group BW1, and the second red-green pixel group RG2 are sequentially and repeatedly arranged in the (h+3)th row ROW_h+3 of the liquid crystal panel 102.

Red pixels of a red pixel diagonal group RDG_2 of the liquid crystal panel 102 shown in FIG. 5 are arranged in a direction different from the direction in which the red pixels of the red pixel diagonal group RDG of the liquid crystal panel 100 shown in FIG. 3 are arranged. The red pixel diagonal group RDG_2 includes the red pixels located at positions satisfying the condition that a number of columns decreases by 2 when a number of rows increases by 1. The red pixels included in a same red pixel diagonal group RDG_2 receive the data voltages having the same polarity. The red pixels included in the red pixel diagonal group RDG_2 are arranged in the fourth direction DR4.

Green pixels of a green pixel diagonal group GDG_2 of the liquid crystal panel 102 shown in FIG. 5 are arranged in a direction different from the direction in which the green pixels of the green pixel diagonal group GDG of the liquid crystal panel 100 shown in FIG. 3 are arranged. The green pixel diagonal group GDG_2 includes the green pixels located at positions satisfying the condition that the number of columns decreases by 2 when the number of rows increases by 1. The green pixels included in a same green pixel diagonal group GDG_2 receive the data voltages having the same polarity. The green pixels included in the green pixel diagonal group GDG_2 are arranged in the fourth direction DR4.

Blue pixels of a blue pixel diagonal group BDG_2 of the liquid crystal panel 102 shown in FIG. 5 are arranged in a direction different from the direction in which the blue pixels of the blue pixel diagonal group BDG of the liquid crystal panel 100 shown in FIG. 3 are arranged. The blue pixel diagonal group BDG_2 includes the blue pixels located at positions satisfying the condition that the number of columns increases by 2 when the number of rows increases by 1. The blue pixels included in a same blue pixel diagonal group BDG_2 receive the data voltages having the same polarity. The blue pixels included in the blue pixel diagonal group BDG_2 are arranged in the third direction DR3.

White pixels of a white pixel diagonal group WDG_2 of the liquid crystal panel 102 shown in FIG. 5 are arranged in a direction different from the direction in which the white pixels of the white pixel diagonal group WDG of the liquid crystal panel 100 shown in FIG. 3 are arranged. The white pixel diagonal group WDG_2 includes the white pixels located at positions satisfying the condition that the number of columns increases by 2 when the number of rows increases by 1. The white pixels included in a same white pixel diagonal group WDG_2 receive the data voltages having the same polarity. The white pixels included in the white pixel diagonal group WDG_2 are arranged in the third direction DR3.

In the liquid crystal panel 102 shown in FIG. 5, the polarities of the data voltages applied to earlier four pixels (e.g., pixels arranged in the first to fourth columns) from among the pixels arranged in the h-th row ROW_h and the (h+1)th row ROW_h+1 are +, −, −, and +, respectively, and the polarities of the data voltages applied to later four pixels (e.g., pixels arranged in the fifth to eighth columns) following the earlier four pixels from among the pixels arranged in the h-th row ROW_h and the (h+1)th row ROW_h+1 are −, +, +, and −, respectively. In addition, the polarities of the data voltages applied to earlier four pixels (e.g., pixels arranged in the first to fourth columns) from among the pixels arranged in the (h+2)th row ROW_h+2 and the (h+3)th row ROW_h+3 are −, +, +, and −, respectively, and the polarities of the data voltages applied to later four pixels (e.g., pixels arranged in the fifth to eighth columns) following the earlier four pixels from among the pixels arranged in the (h+2)th row ROW_h+2 and the (h+3)th row ROW_h+3 are +, −, −, and +, respectively.

According to the present exemplary embodiment, the polarities of the data voltages applied to the pixels may be changed in various ways in accordance with the arrangements of the first and second red-green pixel groups RG1 and RG2 and the first and second blue-white pixel groups BW1 and BW2, without changing the arrangement of the polarities of the data voltages applied to the data lines.

Figure 6:
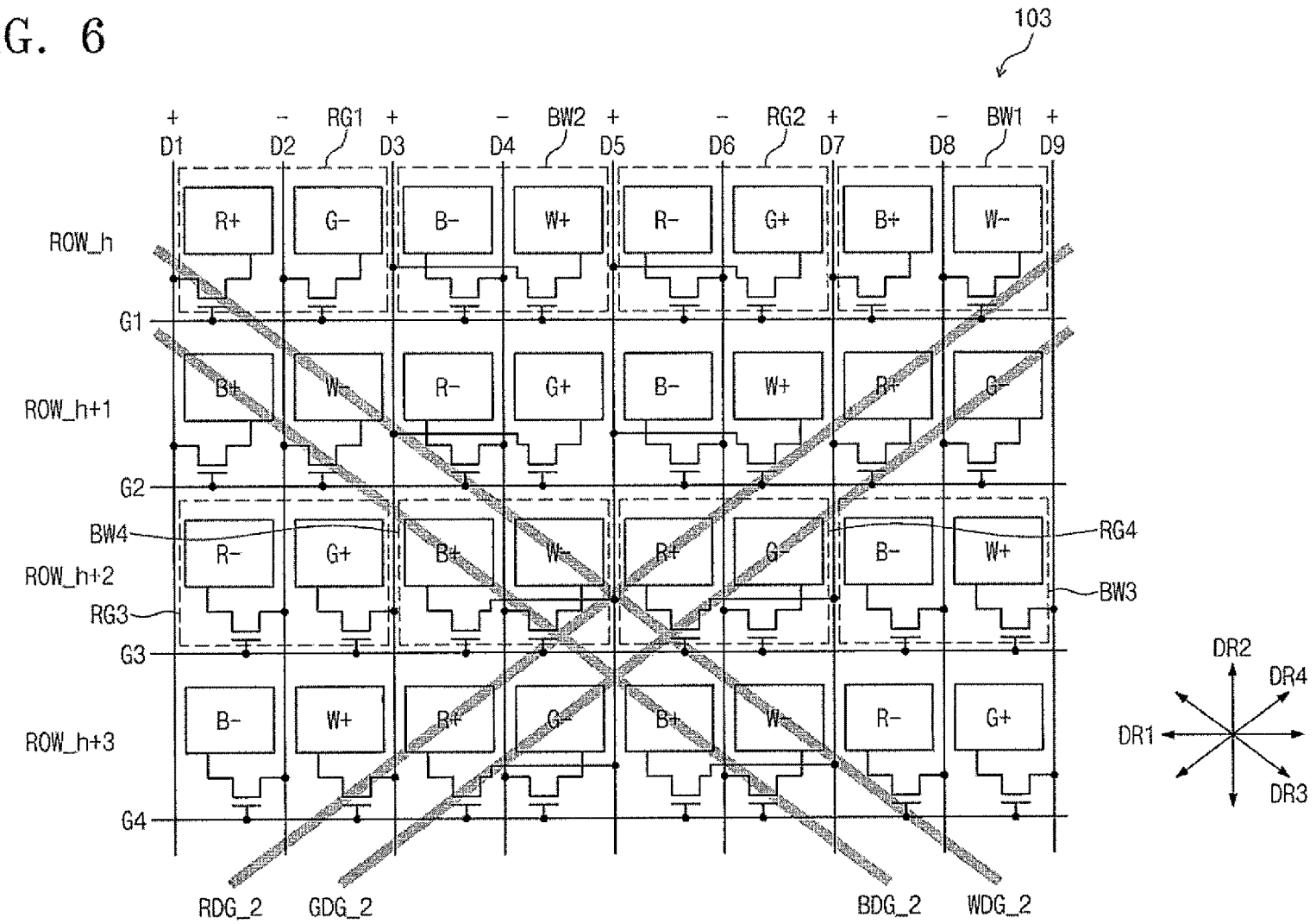

FIG. 6 is a plan view showing a portion of a liquid crystal panel 103 according to an exemplary embodiment of the present invention.

Hereinafter, different features between the liquid crystal panel 103 shown in FIG. 6 and the liquid crystal panel 102 shown in FIG. 5 will be mainly described.

Referring to FIG. 6, the arrangements of the pixel groups in the h-th row ROW_h and the (h+1)th row ROW_h+1 of the liquid crystal panel 103 are the same or substantially the same as those of the liquid crystal panel 102 shown in FIG. 5.

The third red-green pixel group RG3, the fourth blue-white pixel group BW4, the fourth red-green pixel group RG4, and the third blue-white pixel group BW3 are sequentially and repeatedly arranged in the (h+2)th row ROW_h+2 of the liquid crystal panel 103.

The third blue-white pixel group BW3, the fourth red-green pixel group RG4, the fourth blue-white pixel group BW4, and the third red-green pixel group RG3 are sequentially and repeatedly arranged in the (h+3)th row ROW_h+3 of the liquid crystal panel 103.

According to the present exemplary embodiment, the polarities of the data voltages applied to the pixels may be changed in various ways in accordance with the arrangements of the first to fourth red-green pixel groups RG1 to RG4 and the first to fourth blue-white pixel groups BW1 to BW4, without changing the arrangement of the polarities of the data voltages applied to the data lines.

Figure 7:
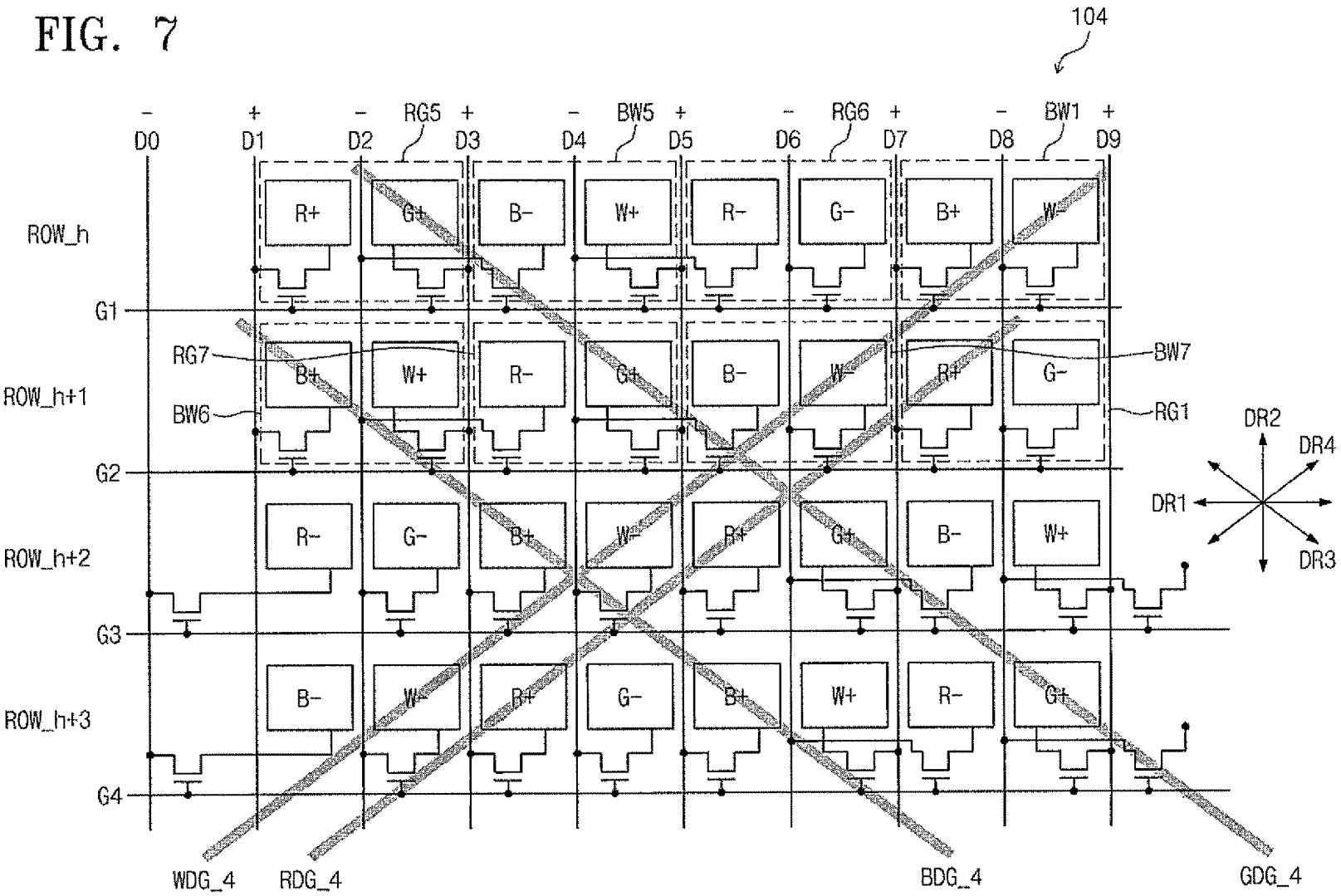

FIG. 7 is a plan view showing a portion of a liquid crystal panel 104 according to an exemplary embodiment of the present invention.

Hereinafter, different features between the liquid crystal panel 104 shown in FIG. 7 and the liquid crystal panel 100 shown in FIG. 3 will be mainly described.

Referring to FIG. 7, the red-green pixel group includes the first red-green pixel group RG1, and fifth to seventh red-green pixel groups RG5 to RG7. Each of the first red-green pixel group RG1 and the fifth to seventh red-green pixel groups RG5 to RG7 includes the red pixel arranged between the y-th data line and the (y+1)th data line, and the green pixel arranged between the (y+1)th data line and the (y+2)th data line.

Hereinafter, the first red-green pixel group refers to the red-green pixel group RG1 including the red pixel connected to the y-th data line and the green pixel connected to the (y+1)th data line.

Hereinafter, the fifth red-green pixel group refers to the red-green pixel group RG5 including the red pixel connected to the y-th data line and the green pixel connected to the (y+2)th data line.

Hereinafter, the sixth red-green pixel group refers to the red-green pixel group RG6 including the red pixel connected to the (y−1)th data line and the green pixel connected to the (y+1)th data line.

Hereinafter, the seventh red-green pixel group refers to the red-green pixel group RG7 including the red pixel connected to the (y−1)th data line and the green pixel connected to the (y+2)th data line.

The blue-white pixel group includes the first blue-white pixel group BW1 and fifth to seventh blue-white pixel groups BW5 to BW7. Each of the first blue-white pixel group BW1 and the fifth to seventh blue-white pixel groups BW5 to BW7 includes the blue pixel arranged between the j-th data line and the (j+1)th data line, and the white pixel arranged between the (j+1)th data line and the (j+2)th data line.

Hereinafter, the first blue-white pixel group refers to the blue-white pixel group BW1 including the blue pixel connected to the j-th data line and the white pixel connected to the (j+1)th data line.

Hereinafter, the fifth blue-white pixel group refers to the blue-white pixel group BW5 including the blue pixel connected to the (j−1)th data line and the white pixel connected to the (j+2)th data line.

Hereinafter, the sixth blue-white pixel group refers to the blue-white pixel group BW6 including the blue pixel connected to the j-th data line and the white pixel connected to the (j+2)th data line.

Hereinafter, the seventh blue-white pixel group refers to the blue-white pixel group BW7 including the blue pixel connected to the (j−1)th data line and the white pixel connected to the (j+1)th data line.

In the present exemplary embodiment shown in FIG. 7, the fifth red-green pixel group RG5, the fifth blue-white pixel group BW5, the sixth red-green pixel group RG6, and the first blue-white pixel group BW1 are sequentially and repeatedly arranged in the h-th row ROW_h of the liquid crystal panel 104.

The sixth blue-white pixel group BW6, the seventh red-green pixel group RG7, the seventh blue-white pixel group BW7, and the first red-green pixel group RG1 are sequentially and repeatedly arranged in the (h+1)th row ROW_h+1 of the liquid crystal panel 104.

The sixth red-green pixel group RG6, the first blue-white pixel group BW1, the fifth red-green pixel group RG5, and the fifth blue-white pixel group BW5 are sequentially and repeatedly arranged in the (h+2)th row ROW_h+2 of the liquid crystal panel 104.

The seventh blue-white pixel group BW7, the first red-green pixel group RG1, the sixth blue-white pixel group BW6, and the seventh red-green pixel group RG7 are sequentially and repeatedly arranged in the (h+3)th row ROW_h+3 of the liquid crystal panel 104.

Red pixels of a red pixel diagonal group RDG_4 of the liquid crystal panel 104 shown in FIG. 7 are arranged in a direction different from the direction in which the red pixels of the red pixel diagonal group RDG of the liquid crystal panel 100 shown in FIG. 3 are arranged. The red pixel diagonal group RDG_4 includes the red pixels located at positions satisfying the condition that the number of columns decreases by 2 when the number of rows increases by 1. The red pixels included in a same red pixel diagonal group RDG_4 receive the data voltages having the same polarity. The red pixels included in the red pixel diagonal group RDG_4 are arranged in the fourth direction DR4.

Green pixels of a green pixel diagonal group GDG_4 of the liquid crystal panel 104 shown in FIG. 7 are arranged in a direction different from the direction in which the green pixels of the green pixel diagonal group GDG of the liquid crystal panel 100 shown in FIG. 3 are arranged. The green pixel diagonal group GDG_4 includes the green pixels located at positions satisfying the condition that the number of columns increases by 2 when the number of rows increases by 1. The green pixels included in a same green pixel diagonal group GDG_4 receive the data voltages having the same polarity. The green pixels included in the green pixel diagonal group GDG_4 are arranged in the third direction DR3.

Blue pixels of a blue pixel diagonal group BDG_4 of the liquid crystal panel 104 shown in FIG. 7 are arranged in a direction different from the direction in which the blue pixels of the blue pixel diagonal group BDG of the liquid crystal panel 100 shown in FIG. 3 are arranged. The blue pixel diagonal group BDG_4 includes the blue pixels located at positions satisfying the condition that the number of columns increases by 2 when the number of rows increases by 1. The blue pixels included in a same blue pixel diagonal group BDG_4 receive the data voltages having the same polarity. The blue pixels included in the blue pixel diagonal group BDG_4 are arranged in the third direction DR3.

White pixels of a white pixel diagonal group WDG_4 of the liquid crystal panel 104 shown in FIG. 7 are arranged in a direction different from the direction in which the white pixels of the white pixel diagonal group WDG of the liquid crystal panel 100 shown in FIG. 3 are arranged. The white pixel diagonal group WDG_4 includes the white pixels located at positions satisfying the condition that the number of columns decreases by 2 when the number of rows increases by 1. The white pixels included in a same white pixel diagonal group WDG_4 receive the data voltages having the same polarity. The white pixels included in the white pixel diagonal group WDG_4 are arranged in the fourth direction DR4.

In the liquid crystal panel 104 shown in FIG. 7, the polarities of the data voltages applied to earlier four pixels (e.g., pixels arranged in the first to fourth columns) from among the pixels arranged in the h-th row ROW_h and the (h+1)th row ROW_h+1 are +, +, −, and +, respectively, and the polarities of the data voltages applied to later four pixels (e.g., pixels arranged in the fifth to eighth columns) following the earlier four pixels from among the pixels arranged in the h-th row ROW_h and the (h+1)th row ROW_h+1 are −, −, +, and −, respectively. In addition, the polarities of the data voltages applied to earlier four pixels (e.g., pixels arranged in the first to fourth columns) from among the pixels arranged in the (h+2)th row ROW_h+2 and the (h+3)th row ROW_h+3 are −, −, +, and −, respectively, and the polarities of the data voltages applied to later four pixels (e.g., pixels arranged in the fifth to eighth columns) following the earlier four pixels from among the pixels arranged in the (h+2)th row ROW_h+2 and the (h+3)th row ROW_h+3 are +, +, −, and +, respectively.

According to the present exemplary embodiment, the polarities of the data voltages applied to the pixels may be changed in various ways in accordance with the arrangements of the first red-green pixel group RG1, the fifth to seventh red-green pixel groups RG5 to RG7, the first blue-white pixel group BW1, and the fifth to seventh blue-white pixel groups BW5 to BW7, without changing the arrangement of the polarities of the data voltages applied to the data lines.

Figure 8:
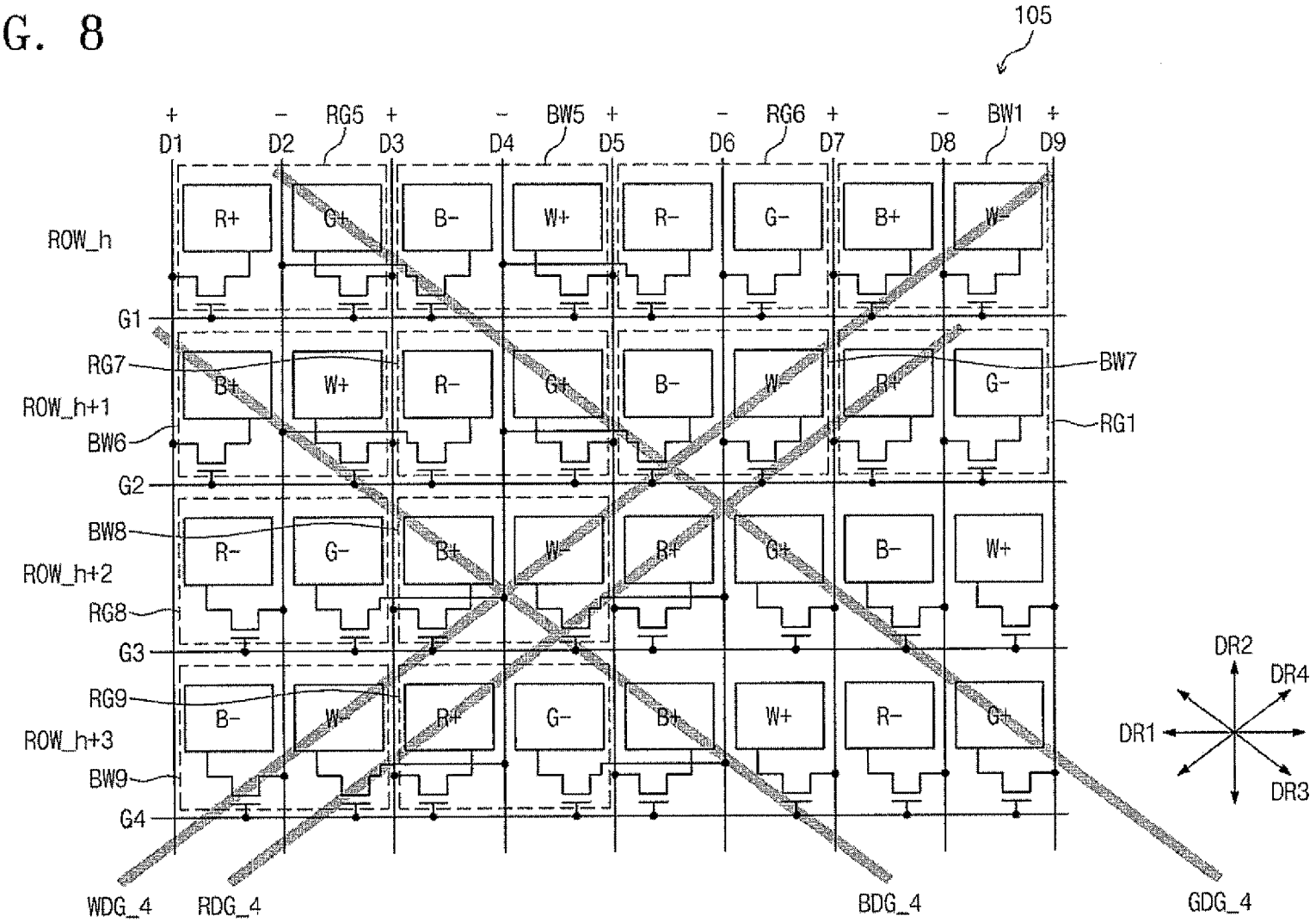

FIG. 8 is a plan view showing a portion of a liquid crystal panel 105 according to an exemplary embodiment of the present invention.

Hereinafter, different features between the liquid crystal panel 105 shown in FIG. 8 and the liquid crystal panel 104 shown in FIG. 7 will be mainly described.

Referring to FIG. 8, the red-green pixel group may further include eighth and ninth red-green pixel groups RG8 and RG9.

Hereinafter, the eighth red-green pixel group refers to the red-green pixel group RG8 including the red pixel connected to the (y+1)th data line and the green pixel connected to a (y+3)th data line.

Hereinafter, the ninth red-green pixel group refers to the red-green pixel group RG9 including the red pixel connected to the y-th data line and the green pixel connected to the (y+3)th data line.

The blue-white pixel group may further include eighth and ninth blue-white pixel groups BW8 and BW9.

Hereinafter, the eighth blue-white pixel group refers to the blue-white pixel group BW8 including the blue pixel connected to the j-th data line and the white pixel connected to the (y+3)th data line.

Hereinafter, the ninth blue-white pixel group refers to the blue-white pixel group BW9 including the blue pixel connected to the (j+1)th data line and the white pixel connected to the (j+3)th data line.

The arrangements of the pixel groups in the h-th row ROW_h and the (h+1)th row ROW_h+1 of the liquid crystal panel 105 shown in FIG. 8 are the same or substantially the same as those of the liquid crystal panel 104 shown in FIG. 7.

The eighth red-green pixel group RG8, the eighth blue-white pixel group BW8, the fifth red-green pixel group RG5, and the third blue-white pixel group BW3 are sequentially and repeatedly arranged in the (h+2)th row ROW_h+2 of the liquid crystal panel 105.

The ninth blue-white pixel group BW9, the ninth red-green pixel group RG9, the sixth blue-white pixel group BW6, and the third red-green pixel group RG3 are sequentially and repeatedly arranged in the (h+3)th row ROW_h+3 of the liquid crystal panel 105.

According to the present exemplary embodiment, the polarities of the data voltages applied to the pixels may be changed in various ways in accordance with the arrangements of the first red-green pixel group RG1, the fifth to ninth red-green pixel groups RG5 to RG9, the first blue-white pixel group BW1, and the fifth to ninth blue-white pixel groups BW5 to BW9, without changing the arrangement of the polarities of the data voltages applied to the data lines.

Figure 9:
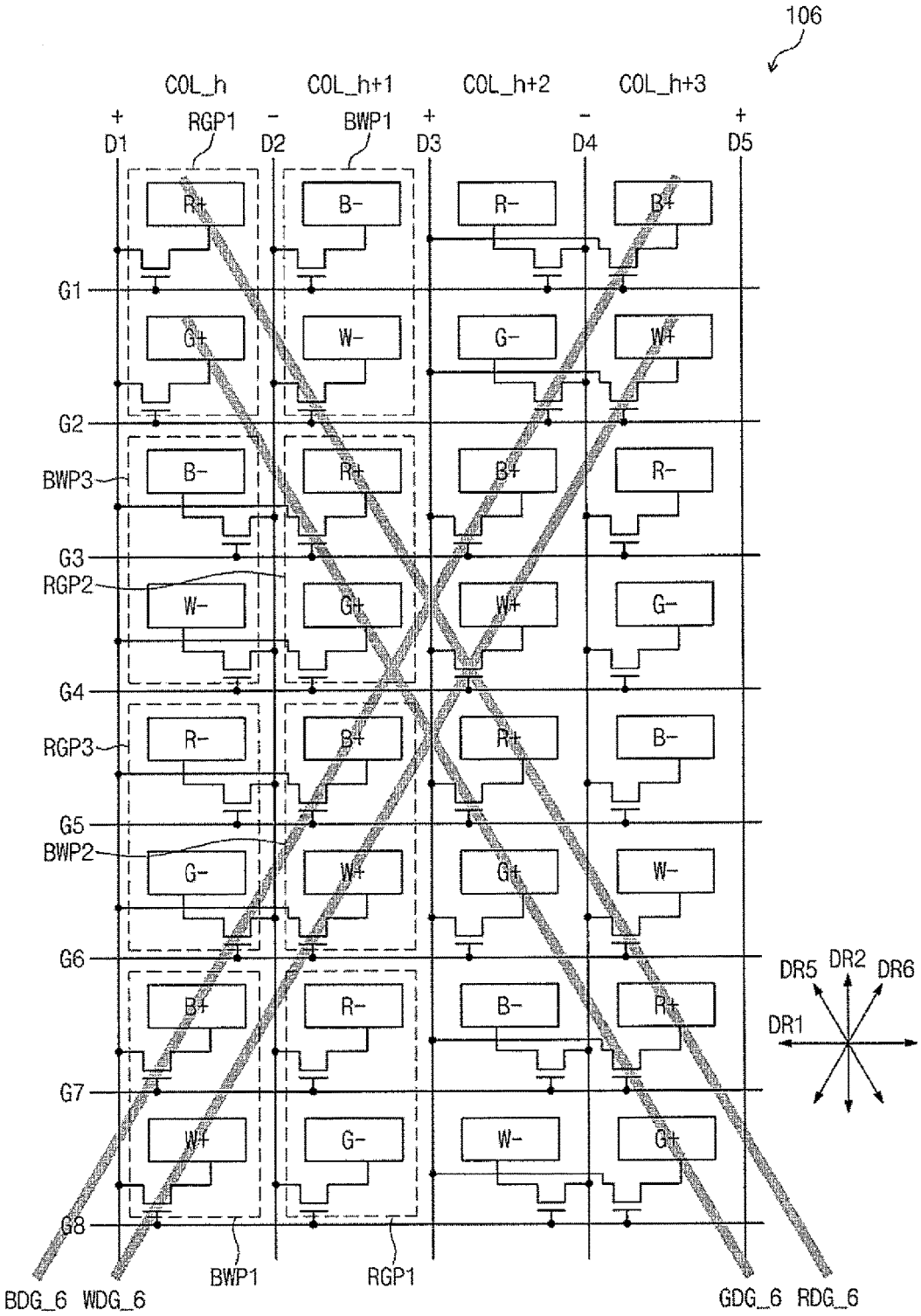

FIG. 9 is a plan view showing a portion of a liquid crystal panel 106 according to an exemplary embodiment of the present invention.

Hereinafter, different features between the liquid crystal panel 106 shown in FIG. 9 and the liquid crystal panel 100 shown in FIG. 3 will be mainly described.

Referring to FIG. 9, the pixels arranged in an h-th (h is a natural number) column COL_h and an (h+2)th column COL_h+2 are repeatedly arranged in order of red, green, blue, and white pixels. The pixels arranged in an (h+1)th column COL_h+1 and an (h+3)th column COL_h+3 are repeatedly arranged in order of blue, white, red, and green pixels. In the present exemplary embodiment shown in FIG. 9, the "h" refers to an odd number, but the "h" may refer to an even number according to some other embodiments.

Although not shown in figures, positions of the red and green pixels may be changed with respect to each other and/or positions of the blue and white pixels may be changed with respect to each other.

The liquid crystal panel 106 includes a red-green pixel group and a blue-white pixel group. The red-green pixel group includes the red pixel and the green pixel adjacent to the red pixel in the second direction DR2. As shown in FIG. 9, the red pixel is located at an upper position in the red-green pixel group, and the green pixel is located at a lower position, but they are not limited thereto or thereby. That is, the green pixel may be located at the upper position and the red pixel may be located at the lower position.

The blue-white pixel group includes the blue pixel and the white pixel adjacent to the blue pixel in the second direction DR2. As shown in FIG. 9, the blue pixel is located at an upper position in the blue-white pixel group and the white pixel is located at a lower position in the blue-white pixel group, but they are not limited thereto or thereby. That is, the white pixel may be located at the upper position and the blue pixel may be located at the lower position.

The red-green pixel group includes first to third red-green pixel groups RGP1 to RGP3. Each of the first to third red-green pixel groups RGP1 to RGP3 includes the red and green pixels arranged between the y-th data line and the (y+1)th data line, and adjacent to each other in the second direction DR2.

Hereinafter, the first red-green pixel group refers to the red-green pixel group RGP1 including the red and green pixels connected to the y-th data line.

Hereinafter, the second red-green pixel group refers to the red-green pixel group RGP2 including the red and green pixels connected to the (y−1)th data line.

Hereinafter, the third red-green pixel group refers to the red-green pixel group RGP3 including the red and green pixels connected to the (y+1)th data line.

The blue-white pixel group includes first to third blue-white pixel groups BWP1 to BWP3. Each of the first to third blue-white pixel groups BWP1 to BWP3 includes the blue and white pixels arranged between the j-th data line and the (j+1)th data line, and adjacent to each other in the second direction DR2.

Hereinafter, the first blue-white pixel group refers to the blue-white pixel group BWP1 including the blue and white pixels connected to the j-th data line.

Hereinafter, the second blue-white pixel group refers to the blue-white pixel group BWP2 including the blue and white pixels connected to the (j−1)th data line.

Hereinafter, the third blue-white pixel group refers to the blue-white pixel group BWP3 including the blue and white pixels connected to the (j+1)th data line.

In the present exemplary embodiment shown in FIG. 9, the first red-green pixel group RGP1, the third blue-white pixel group BWP3, the third red-green pixel group RGP3, and the first blue-white pixel group BWP1 are sequentially and repeatedly arranged in the h-th column COL_h of the liquid crystal panel 106.

The first blue-white pixel group BWP1, the second red-green pixel group RGP2, the second blue-white pixel group BWP2, and the first red-green pixel group RGP2 are sequentially and repeatedly arranged in the (h+1)th column COL_h+1 of the liquid crystal panel 106.

The third red-green pixel group RGP3, the first blue-white pixel group BWP1, the first red-green pixel group RGP1, and the third blue-white pixel group BWP3 are sequentially and repeatedly arranged in the (h+2)th column COL_h+2 of the liquid crystal panel 106.

The second blue-white pixel group BWP2, the first red-green pixel group RGP1, the first blue-white pixel group BWP1, and the second red-green pixel group RGP2 are sequentially and repeatedly arranged in the (h+3)th column COL_h+3 of the liquid crystal panel 106.

The pixels adjacent to each other in the second direction DR2 and having the same color receive the data voltages having different polarities. In other words, the pixels, which have the same color and are adjacent to each other in the second direction DR2 such that three pixels are arranged therebetween, receive the data voltages having different polarities. For example, the red pixel arranged at the first row and the first column receives the positive (+) data voltage, and the red pixel arranged at the fifth row and the first column receives the negative (−) data voltage.

A red pixel diagonal group RDG_6 of the liquid crystal panel 106 shown in FIG. 9 includes the red pixels located at positions satisfying the condition that a number of columns increases by 1 when a number of rows increases by 2. The red pixels included in a same red pixel diagonal group RDG_6 are applied with the data voltages having the same polarity. The red pixels included in the red pixel diagonal group RDG_6 are arranged in a fifth direction DR5. The fifth direction DR5 crosses the first and second directions DR1 and DR2.

A green pixel diagonal group GDG_6 of the liquid crystal panel 106 shown in FIG. 9 includes the green pixels located at positions satisfying the condition that the number of columns increases by 1 when the number of rows increases by 2. The green pixels included in a same green pixel diagonal group GDG_6 are applied with the data voltages having the same polarity. The green pixels included in the green pixel diagonal group GDG_6 are arranged in the fifth direction DR5.

A blue pixel diagonal group BDG_6 of the liquid crystal panel 106 shown in FIG. 9 includes the blue pixels located at positions satisfying the condition that the number of columns decreases by 1 when the number of rows increases by 2. The blue pixels included in a same blue pixel diagonal group BDG_6 are applied with the data voltages having the same polarity. The blue pixels included in the blue pixel diagonal group BDG_6 are arranged in a sixth direction DR6. The sixth direction DR6 crosses the first, second, and fifth directions DR1, DR2, and DR5.

A white pixel diagonal group WDG_6 of the liquid crystal panel 106 shown in FIG. 9 includes the white pixels located at positions satisfying the condition that the number of columns decreases by 1 when the number of rows increases by 2. The white pixels included in a same white pixel diagonal group WDG_6 are applied with the data voltages having the same polarity. The white pixels included in the white pixel diagonal group WDG_6 are arranged in the sixth direction DR6.

The polarity of the data voltages respectively applied to the pixels arranged in the same column is inverted in the unit of four pixels. In the liquid crystal panel 106 shown in FIG. 9, the polarities of the data voltages applied to earlier four pixels (e.g., pixels arranged in the first to fourth rows) from among the pixels arranged in each of the h-th column COL_h and the (h+3)th column COL_h+3 are +, +, −, and −, respectively, and the polarities of the data voltages applied to later four pixels (e.g., pixels arranged in the fifth to eighth rows) following the earlier four pixels from among the pixels arranged in the h-th column COL_h and the (h+3)th column COL _h+3 are −, −, +, and +, respectively. In addition, the polarities of the data voltages applied to earlier four pixels (e.g., pixels arranged in the first to fourth rows) from among the pixels arranged in each of the (h+1)th column COL_h+1 and the (h+2)th column COL_h+2 are −, −, +, and +, respectively, and the polarities of the data voltages applied to later four pixels (e.g., pixels arranged in the fifth to eighth rows) following the earlier four pixels from among the pixels arranged in the (h+1)th column COL_h+1 and the (h+2)th column $COL_{13}$ h+2 are +, +, −, and −, respectively.

According to the present exemplary embodiment, the polarities of the data voltages applied to the pixels may be changed in various ways in accordance with the arrangements of the first to third red-green pixel groups RGP1 to RGP3 and the first to third blue-white pixel groups BWP1 to BWP3, without changing the arrangement of the polarities of the data voltages applied to the data lines.

Figure 10:
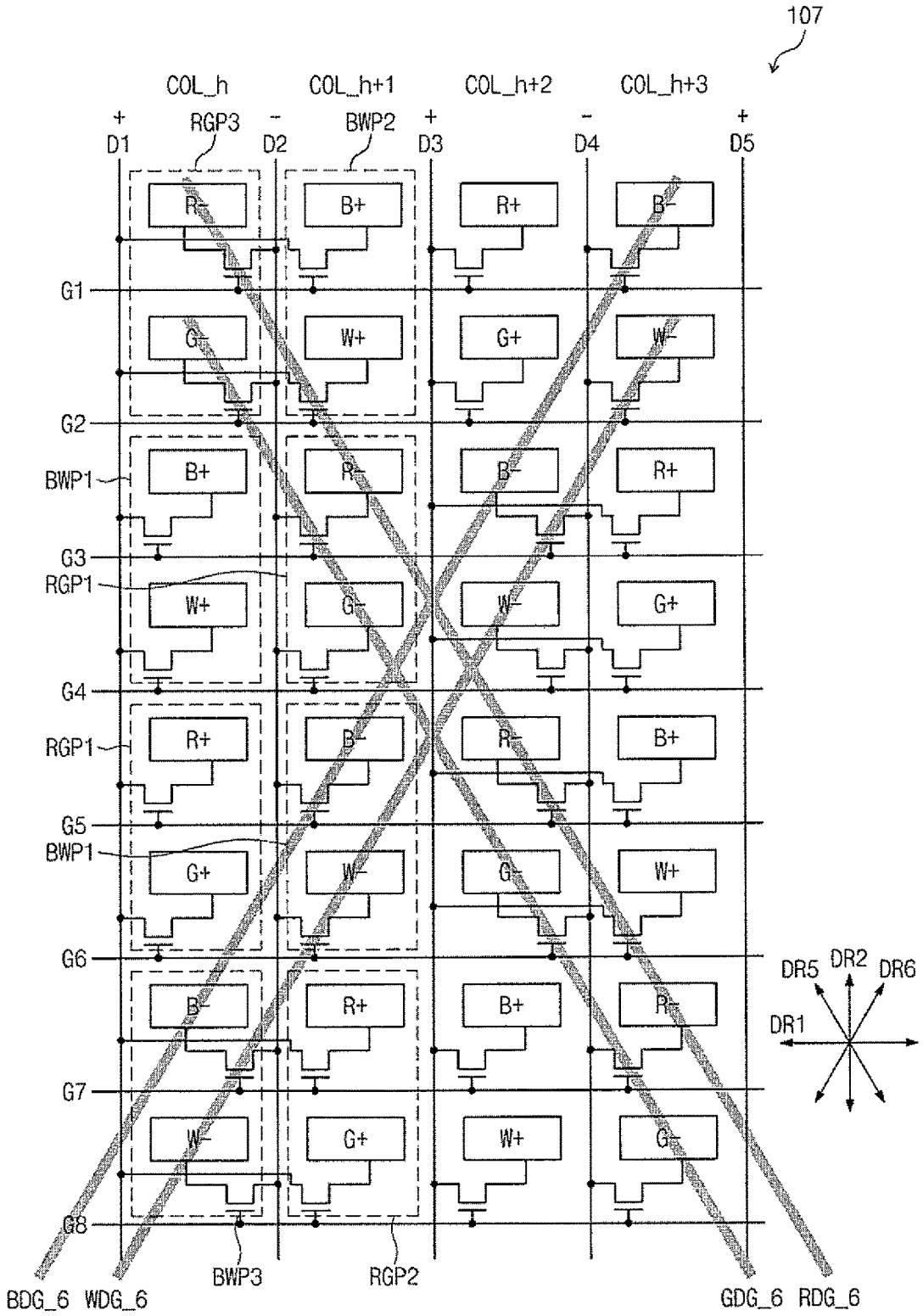

FIG. 10 is a plan view showing a portion of a liquid crystal panel 107 according to an exemplary embodiment of the present invention.

Hereinafter, different features between the liquid crystal panel 107 shown in FIG. 10 and the liquid crystal panel 106 shown in FIG. 9 will be mainly described.

Referring to FIG. 10, the third red-green pixel group RGP3, the first blue-white pixel group BWP1, the first red-green pixel group RGP1, and the third blue-white pixel group BWP3 are sequentially and repeatedly arranged in the h-th column COL_h of the liquid crystal panel 107.

The second blue-white pixel group BWP2, the first red-green pixel group RGP1, the first blue-white pixel group BWP1, and the second red-green pixel group RGP2 are sequentially and repeatedly arranged in the (h+1)th column COL_h+1 of the liquid crystal panel 107.

The first red-green pixel group RGP1, the third blue-white pixel group BWP3, the third red-green pixel group RGP3, and the first blue-white pixel group BWP1 are sequentially and repeatedly arranged in the (h+2)th column COL_h+2 of the liquid crystal panel 107.

The first blue-white pixel group BWP1, the second red-green pixel group RGP2, the second blue-white pixel group BWP2, and the first red-green pixel group RGP1 are sequentially and repeatedly arranged in the (h+3)th column COL_h+3 of the liquid crystal panel 107.

In the liquid crystal panel 107 shown in FIG. 10, the polarities of the data voltages applied to earlier four pixels (e.g., pixels arranged in the first to fourth rows) from among the pixels arranged in each of the h-th column COL_h and the (h+3)th column COL_h+3 are −, −, +, and +, respectively, and the polarities of the data voltages applied to later four pixels (e.g., pixels arranged in the fifth to eighth rows) following the earlier four pixels from among the pixels arranged in the h-th column COL_h and the (h+3)th column COL_h+3 are +, +, −, and −, respectively. In addition, the polarities of the data voltages applied to earlier four pixels (e.g., pixels arranged in the first to fourth rows) from among the pixels arranged in each of the (h+1)th column COL_h+1 and the (h+2)th column COL__ h+2 are +, +, −, and −, respectively, and the polarities of the data voltages applied to later four pixels (e.g., pixels arranged in the fifth to eighth rows) following the earlier four pixels from among the pixels arranged in the (h+1)th column COL_h+1 and the (h+2)th column COL_h+2 are −, −, +, and +, respectively.

According to the present exemplary embodiment, the polarities of the data voltages applied to the pixels may be changed in various ways in accordance with the arrangements of the first to third red-green pixel groups RGP1 to RGP3 and the first to third blue-white pixel groups BWP1 to BWP3, without changing the arrangement of the polarities of the data voltages applied to the data lines.

Figure 11:
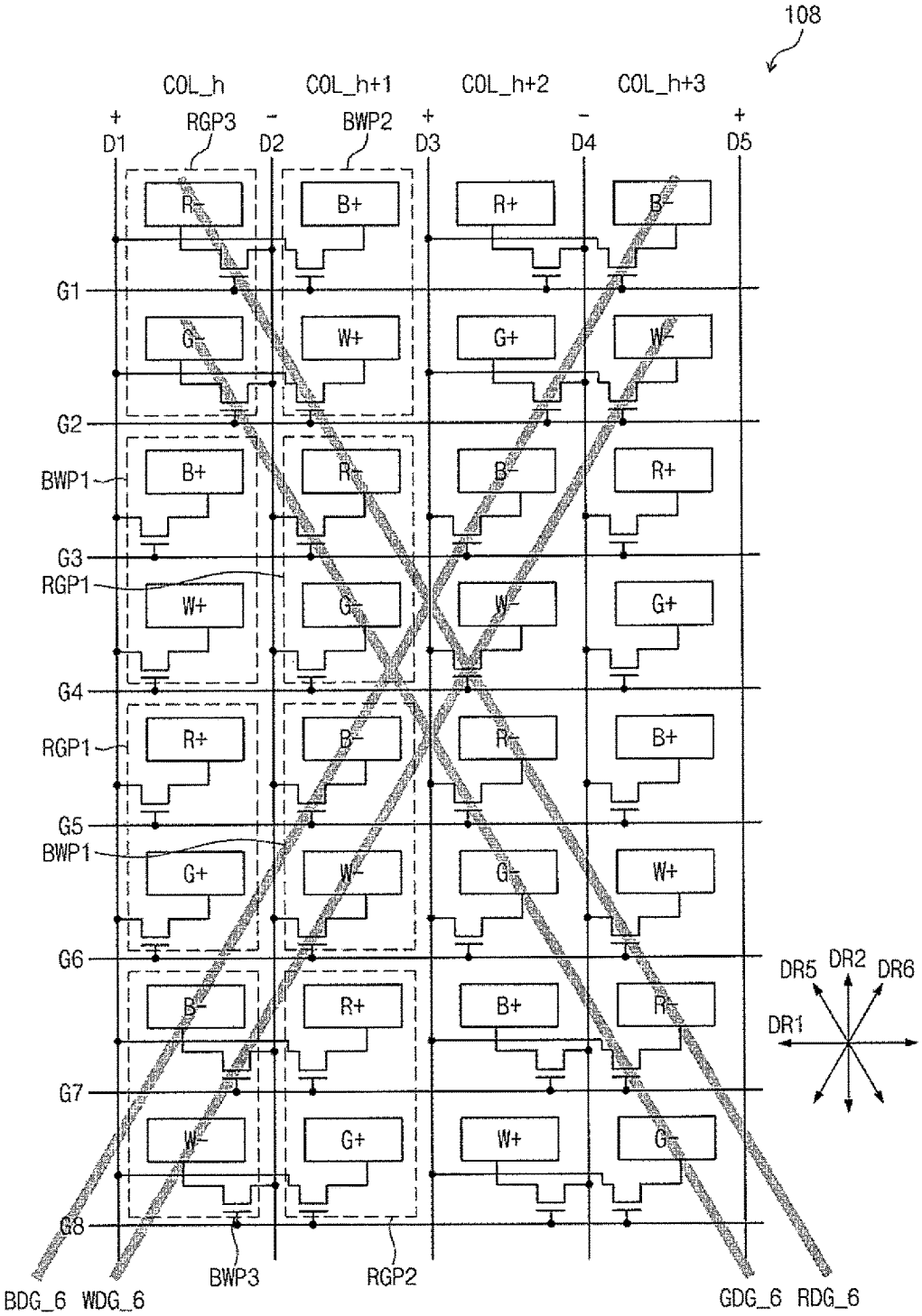

FIG. 11 is a plan view showing a portion of a liquid crystal panel 108 according to an exemplary embodiment of the present invention.

Hereinafter, different features between the liquid crystal panel 108 shown in FIG. 11 and the liquid crystal panel 106 shown in FIG. 9 will be mainly described.

Referring to FIG. 11, the third red-green pixel group RGP3, the first blue-white pixel group BWP1, the first red-green pixel group RGP1, and the third blue-white pixel group BWP3 are sequentially and repeatedly arranged in the h-th column COL_h of the liquid crystal panel 108.

The second blue-white pixel group BWP2, the first red-green pixel group RGP1, the first blue-white pixel group BWP1, and the second red-green pixel group RGP2 are sequentially and repeatedly arranged in the (h+1)th column COL_h+1 of the liquid crystal panel 108.

The third red-green pixel group RGP3, the first blue-white pixel group BWP1, the first red-green pixel group RGP1, and the third blue-white pixel group BWP3 are sequentially and repeatedly arranged in the (h+2)th column COL_h+2 of the liquid crystal panel 108.

The second blue-white pixel group BWP2, the first red-green pixel group RGP1, the first blue-white pixel group BWP1, and the second red-green pixel group RGP2 are sequentially and repeatedly arranged in the (h+3)th column COL_h+3 of the liquid crystal panel 108.

In the liquid crystal panel 108 shown in FIG. 11, the polarities of the data voltages applied to earlier four pixels (e.g., pixels arranged in the first to fourth rows) from among the pixels arranged in each of the h-th column COL_h and the (h+3)th column COL_h+3 are −, −, +, and +, respectively, and the polarities of the data voltages applied to later four pixels (e.g., pixels arranged in the fifth to eighth rows) following the earlier four pixels from among the pixels arranged in the h-th column COL_h and the (h+3)th column COL_h+3 are +, +, −, and −, respectively. In addition, the polarities of the data voltages applied to earlier four pixels (e.g., pixels arranged in the first to fourth rows) from among the pixels arranged in each of the (h+1)th column COL_h+1 and the (h+2)th column COL_h+2 are +, +, −, and −, respectively, and the polarities of the data voltages applied to later four pixels (e.g., pixels arranged in the fifth to eighth rows) following the earlier four pixels from among the pixels arranged in the (h+1)th column COL_h+1 and the (h+2)th column COL_h+2 are −, −, +, and +, respectively.

According to the present exemplary embodiment, the polarities of the data voltages applied to the pixels may be changed in various ways in accordance with the arrangements of the first to third red-green pixel groups RGP1 to RGP3 and the first to third blue-white pixel groups BWP1 to BWP3 without changing the arrangement of the polarities of the data voltages applied to the data lines.

The electronic or electric devices and/or any other relevant devices or components according to exemplary embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Although the exemplary embodiments of the present invention have been described, it will be understood that the present invention is not limited to these exemplary embodiments, and various changes and modifications may be made as understood by those of ordinary skilled in the art within the spirit and scope of the present invention as defined in the following claims, and their equivalents.

What is claimed is:

1. A display apparatus comprising:

a plurality of gate lines extending in a first direction;

a plurality of data lines extending in a second direction crossing the first direction; and a plurality of pixels connected to the gate lines and the data lines, the plurality of pixels comprising:

first color pixels configured to display a first color;

second color pixels configured to display a second color different from the first color;

third color pixels configured to display a third color different from the first and second colors; and fourth color pixels configured to display a fourth color different from the first, second, and third colors, wherein a first color pixel from among the first color pixels arranged in an f-th (f is a natural number) column between an f-th data line and an (f+1)th data line is connected to one of the f-th data line and the (f+1)th data line, wherein a first color pixel from among the first color pixels arranged in a g-th (g is a natural number different from f) column between a g-th data line and a (g+1)th data line is connected to one of a (g−1)th data line and a (g+2)th data line, and a second color pixel from among the second color pixels arranged in the g-th column, and overlapping in the second direction with the first color pixel of the g-th column, is connected to one of the g-th data line and the (g+1)th data line, wherein first color pixels from among the first color pixels that are adjacent to each other in a third direction crossing the first and second directions form a first color pixel diagonal group, the first color pixels of the first color pixel diagonal group being configured to receive data voltages having a same polarity, wherein second color pixels from among the second color pixels that are adjacent to each other in a fourth direction crossing the first, second, and third directions form a second color pixel diagonal group, the second color pixels of the second color pixel diagonal group being configured to receive data voltages having a same polarity, wherein the first, second, third, and fourth colors are:

red, blue, green, and white colors, respectively;

green, blue, red, and white colors, respectively;

red, white, green, and blue colors, respectively; or green, white, red, and blue colors, respectively, wherein a red-green pixel group and a blue-white pixel group are defined, wherein the red-green pixel group comprises the first color pixel arranged between a y-th (y is a natural number) data line and a (y+1)th data line from among the data lines, and the third color pixel arranged between the (y+1)th data line and a (y+2)th data line from among the data lines and adjacent to the first color pixel in the first direction, wherein a blue-white pixel group comprises the second color pixel arranged between a j-th (j is a natural number) data line and a (j+1)th data line from among the data lines, and the fourth color pixel arranged between the (j+1)th data line and a (j+2)th data line from among the data lines and adjacent to the second color pixel in the first direction, wherein:

the red-green pixel group comprises:

a first red-green pixel group comprising the first color pixel connected to the y-th data line and the third color pixel connected to the (y+1)th data line;

a second red-green pixel group comprising the first color pixel connected to the y-th data line and the third color pixel connected to the (y+2)th data line;

a third red-green pixel group comprising the first color pixel connected to a (y−1)th data line and the third color pixel connected to the (y+1)th data line; and a fourth red-green pixel group comprising the first color pixel connected to the (y−1)th data line and the third color pixel connected to the (y+2)th data line; and the blue-white pixel group comprises:

a first blue-white pixel group comprising the second color pixel connected to the j-th data line and the fourth color pixel connected to the (j+1)th data line;

a second blue-white pixel group comprising the second color pixel connected to a (j−1)th data line and the fourth color pixel connected to the (j+2)th data line:

a third blue-white pixel group comprising the second color pixel connected to the j-th data line and the fourth color pixel connected to the (j+2)th data line; and a fourth blue-white pixel group comprising the second color pixel connected to the (j−1)th data line and the fourth color pixel connected to the (j+1)th data line.

2. The display apparatus of claim 1, wherein the first color pixel diagonal group comprises a plurality of first color pixel diagonal groups, the data voltages applied to the first color pixel diagonal groups that are adjacent to each other have opposite polarities to each other, and wherein the second color pixel diagonal group comprises a plurality of second color pixel diagonal groups, the data voltages applied to the second color pixel diagonal groups adjacent to each other have opposite polarities to each other.

3. The display apparatus of claim 2, wherein the first color pixels included in a same one of the first color pixel diagonal groups receive the data voltages having the same polarity, and the second color pixels included in a same one of the second color pixel diagonal groups receive the data voltages having the same polarity.

4. The display apparatus of claim 1, wherein the first color is one of red and blue colors, and the second color is the other one of the red and blue colors, or wherein the first color is one of white and green colors, and the second color is the other one of the white and green colors.

5. The display apparatus of claim 4, wherein the first color pixels of the first color pixel diagonal group are located at positions satisfying a condition where a number of columns increases by 1 when a number of rows increases by 2, respectively, and the second color pixels of the second color pixel diagonal group are located at positions satisfying a condition where the number of columns decreases by 1 when the number of rows increases by 2, respectively.

6. The display apparatus of claim 5, wherein pixels arranged in an h-th (h is a natural number) column and an (h+2)th column from among the plurality of pixels are arranged in order of the first color pixel, the third color pixel, the second color pixel, and the fourth color pixel, and pixels arranged in an (h+1)th column and an (h+3)th column from among the plurality of pixels are arranged in order of the second color pixel, the fourth color pixel, the first color pixel, and the third color pixel.

7. The display apparatus of claim 4, wherein the first color pixels of the first color pixel diagonal group are located at positions satisfying a condition where a number of columns increases by 2 when a number of rows increases by 1, respectively, and the second color pixels of the second color pixel diagonal group are located at positions satisfying a condition where the number of columns decreases by 2 when the number of rows increases by 1, respectively.

8. The display apparatus of claim 1, wherein pixels arranged in an h-th (h is a natural number) row and an (h+2)th row from among the plurality of pixels are arranged in order of the first color pixel, the third color pixel, the second color pixel, and the fourth color pixel, and pixels arranged in an (h+1)th row and an (h+3)th row from among the plurality of pixels are arranged in order of the second color pixel, the fourth color pixel, the first color pixel, and the third color pixel.

9. The display apparatus of claim 1, wherein:

the red-green pixel group further comprises:

a fifth red-green pixel group comprising the first color pixel connected to the (y+1)th data line and the third color pixel connected to a (y+3)th data line; and a sixth red-green pixel group comprising the first color pixel connected to the y-th data line and the third color pixel connected to the (y+3)th data line; and the blue-white pixel group further comprises:

a fifth blue-white pixel group comprising the second color pixel connected to the j-th data line and the fourth color pixel connected to a (j+3)th data line; and a sixth blue-white pixel group comprising the second color pixel connected to the (j+1)th data line and the fourth color pixel connected to the (j+3)th data line.

* * * * *